US011850870B2

(12) United States Patent
Nakatani

(10) Patent No.: US 11,850,870 B2
(45) Date of Patent: Dec. 26, 2023

(54) THERMAL PRINT HEAD AND MANUFACTURING METHOD THEREOF

(71) Applicant: ROHM CO., LTD., Kyoto (JP)

(72) Inventor: Goro Nakatani, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 17/845,912

(22) Filed: Jun. 21, 2022

(65) Prior Publication Data

US 2023/0010313 A1 Jan. 12, 2023

(30) Foreign Application Priority Data

Jul. 8, 2021 (JP) ..... 2021-113772

(51) Int. Cl.
*B41J 2/335* (2006.01)
*B41J 2/345* (2006.01)

(52) U.S. Cl.
CPC ..... *B41J 2/33535* (2013.01); *B41J 2/335* (2013.01); *B41J 2/3353* (2013.01); *B41J 2/3359* (2013.01); *B41J 2/33505* (2013.01); *B41J 2/345* (2013.01)

(58) Field of Classification Search
CPC .... B41J 2/33535; B41J 2/3353; B41J 2/3359; B41J 2/345; B41J 2/33505
See application file for complete search history.

(56) References Cited

U.S. PATENT DOCUMENTS

2020/0406631 A1* 12/2020 Nakatani ..... B41J 2/3355

FOREIGN PATENT DOCUMENTS

JP 07186427 A * 7/1995 ..... B41J 2/3356
JP 2019166824 A 10/2019

* cited by examiner

*Primary Examiner* — Yaovi M Ameh
(74) *Attorney, Agent, or Firm* — HAMRE, SCHUMANN, MUELLER & LARSON, P.C.

(57) ABSTRACT

The present disclosure provides a thermal print head. The thermal print head includes a substrate having a main surface and a convex portion and including a semiconductor material; a resistor layer including a plurality of heat generating portions located on the convex portion; and a wiring layer conducted to the plurality of heat generating portions and formed to contact the resistor layer. The convex portion has a top surface, a first inclined surface and a second inclined surface. The first inclined surface and the second inclined surface are disposed between the main surface and the top surface, separated from each other in a sub-scanning direction, and tilted with respect to the main surface. A first tilted angle of the first inclined surface with respect to the main surface and a second tilted angle of the second inclined surface with respect to the main surface are greater than 55 degrees.

18 Claims, 17 Drawing Sheets

THERMAL PRINT HEAD AND MANUFACTURING METHOD THEREOF

TECHNICAL FIELD

The present disclosure relates to a thermal print head and a manufacturing method thereof.

BACKGROUND

Patent publication 1 disclosed a thermal print head including a substrate made of a silicon-containing material. A substrate of the thermal print head has a main surface, and a convex portion extending in a main scanning direction and protruding from the main surface. As shown in FIG. 6 of patent publication 1, a plurality of heat generating portions are arranged on the convex portion in the main scanning direction. According to the configuration above, a recording medium is enabled to reliably come into contact with the convex portion arranged with the plurality of heat generating portions, thereby achieving enhanced printing quality as anticipated. Accordingly, the substrate of the thermal print head features advantages of higher heat conductivity and lower costs than a substrate made of a material containing aluminum nitride. However, if miniaturization of the thermal print head is desired, a platen roller used to press the recording medium against the thermal print head may interfere with the thermal print head.

PRIOR ART DOCUMENT

Patent Publication

[Patent publication 1] Japan Patent Publication No. 2019-166824

SUMMARY OF THE PRESENT DISCLOSURE

Problems to be Solved by the Present Disclosure

In view of the situations above, it is a task of the present disclosure to provide a thermal print head capable of achieving enhanced printing quality and preventing interference from a platen roller, and a manufacturing method thereof.

Technical Means for Solving the Problem

According to a first aspect of the present disclosure, a thermal print head includes: a substrate, having a main surface that faces a thickness direction and a convex portion that protrudes from the main surface and extends along a main scanning direction, wherein the substrate includes a semiconductor material; a resistor layer, including a plurality of heat generating portions arranged in the main scanning direction and located on the convex portion; and a wiring layer, conducted to the plurality of heat generating portions and formed to contact the resistor layer. The convex portion has a top surface, a first inclined surface and a second inclined surface. The top surface faces the thickness direction and is located away from the main surface. The first inclined surface and the second inclined surface are disposed between the main surface and the top surface, separated from each other in a sub-scanning direction, and tilted with respect to the main surface. The first inclined surface and the second inclined surface become closer to each other from the main surface toward the top surface, and a first tilted angle of the first inclined surface with respect to the main surface and a second tilted angle of the second inclined surface with respect to the main surface are greater than 55 degrees.

According to a second aspect of the present disclosure, a method for manufacturing a thermal print head includes: forming a main surface and a convex portion on a base material that includes a semiconductor material and has a first surface and a second surface facing opposite to each other in a thickness direction, wherein the main surface faces a same side as the first surface in the thickness direction and is located between the first surface and the second surface, and the convex portion protrudes from the main surface and extends in a main scanning direction; forming a resistor layer on the convex portion, the resistor layer including a plurality of heat generating portions arranged in the main scanning direction; and forming a wiring layer in contact with the resistor layer and conducting the plurality of heat generating portions. The forming of the main surface and the convex portion includes recessing the first surface of the base material to form a plurality of grooves extending in the main scanning direction and arranged along the sub-scanning direction. The plurality of grooves have a pair of first inclined surfaces interposed between the main surface and the first surface, separated from each other in the sub-scanning direction, and tilted with respect to the main surface in a direction away from each other from the main surface toward the first surface. A portion of the base material is removed by a blade in the forming of the plurality of grooves.

Effects of the Present Disclosure

The thermal print head and the manufacturing method thereof according to the present disclosure are capable of achieving enhanced printing quality and preventing interference from a platen roller.

Other features and advantages of the present disclosure will become more readily apparent with the detailed description on the basis of the accompanying drawings below.

DETAILED DESCRIPTION OF THE EMBODIMENTS

Implementation details of the present disclosure are described on the basis of the accompanying drawings below.

First Embodiment

Figure 2:
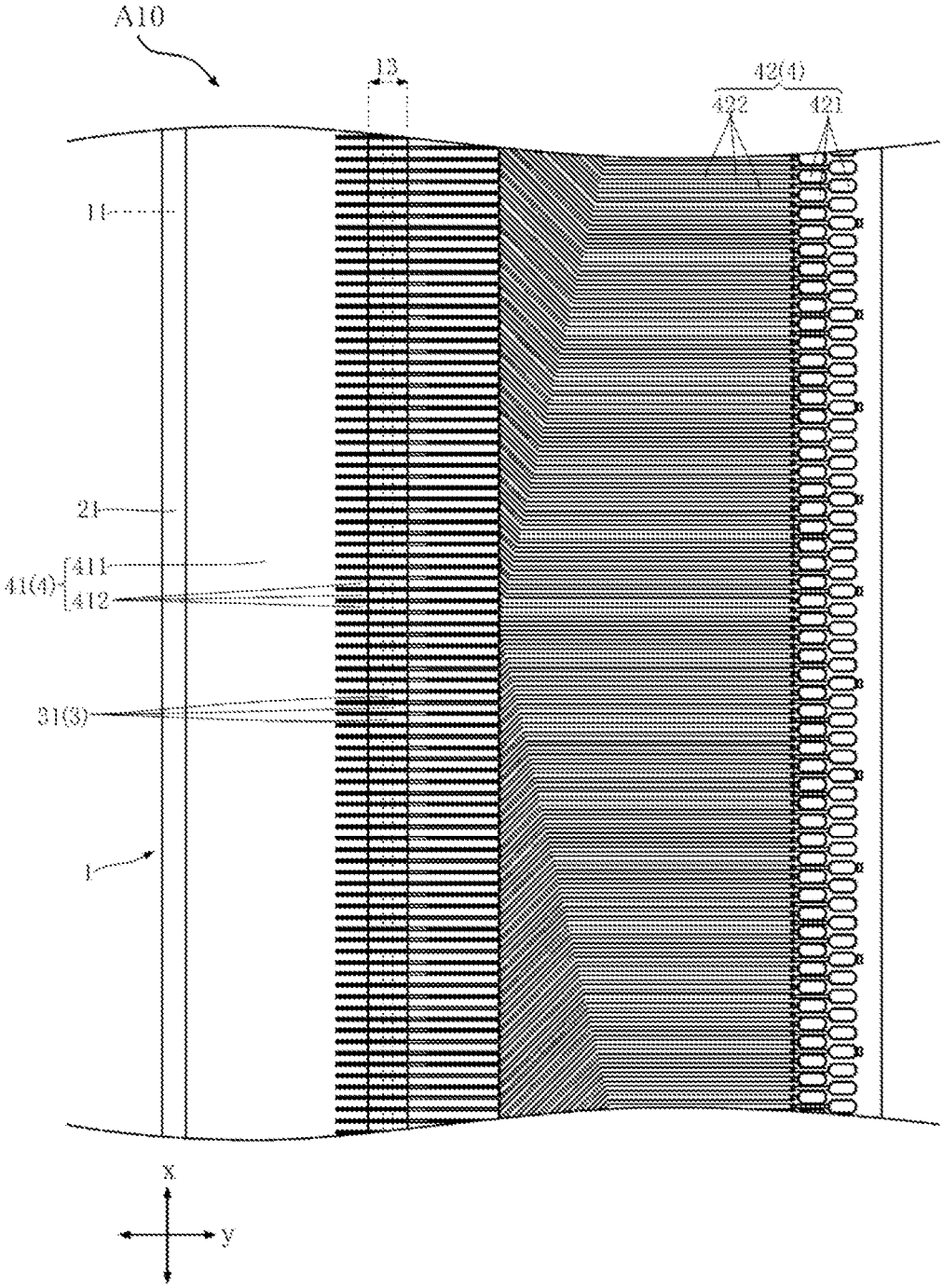
FIG. 2 is a top view of a main part of the thermal print head in FIG. 1.
Figure 3:
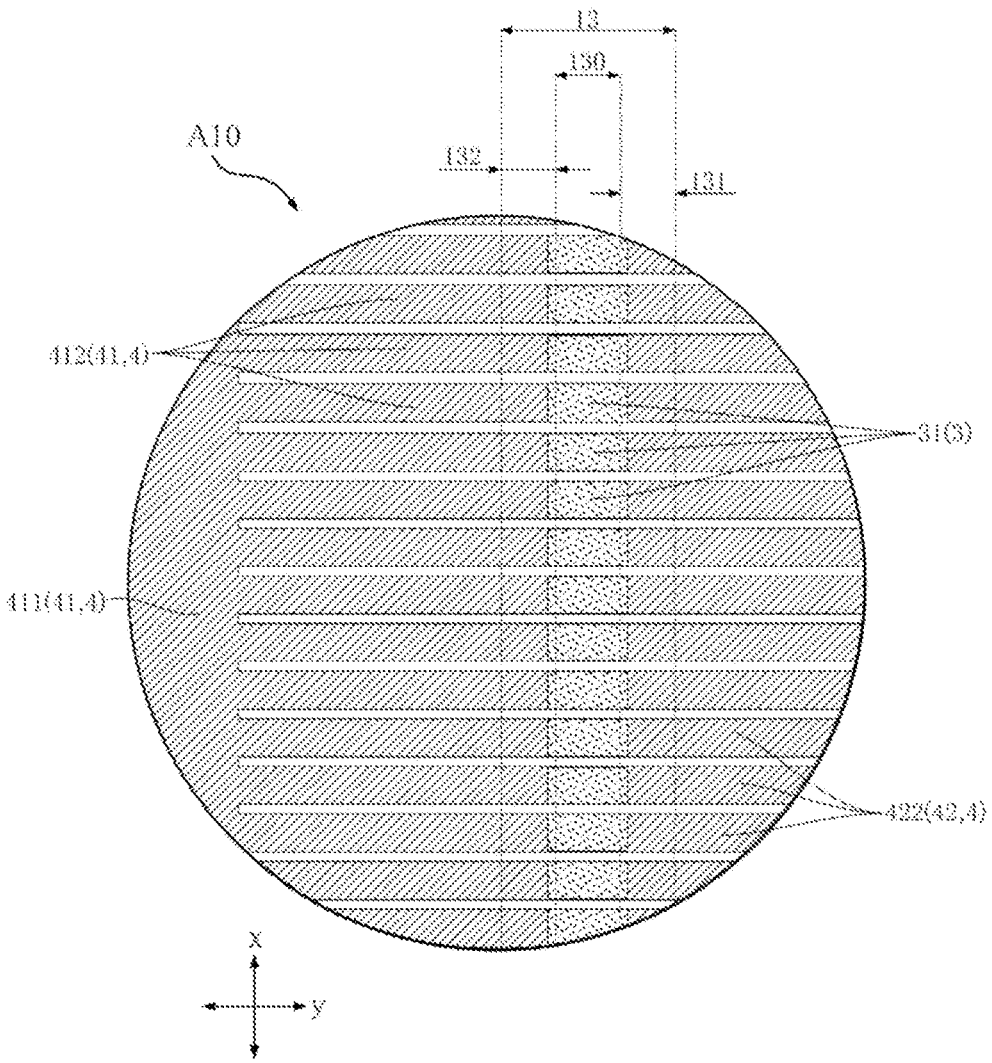
FIG. 3 is a partial enlarged view of FIG. 2.

On the basis of FIG. 1 to FIG. 6, a thermal print head A10 according to a first embodiment of the present disclosure is described below. The thermal print head A10 forms a main part of a thermal printer B10 described below. The thermal print head A10 includes a main part and an attachment part. The main part of the thermal print head A10 includes a substrate 1, an insulating layer 2, a resistor layer 3, a wiring layer 4 and a protective layer 5. The attachment part of the thermal print head A10 includes a wiring substrate 71, a heat dissipation member 72, multiple driving elements 73, multiple first conducting wires 74, multiple second conducting wires 75, a sealing resin 76 and a connector 77. Further, in FIG. 1, for better understanding, observation is made through the protective layer 5, and the multiple first conducting wires 74, the multiple second conducting wires 75 and the sealing resin 76 are omitted from the drawing. In FIG. 2 and FIG. 3, for better understanding, observation is made through the protective layer 5.

Further, for better illustration, a main scanning direction of the thermal print head A10 is referred to as the "x direction", a sub-scanning direction of the thermal print head A10 is referred to as the "y direction", and the thickness direction of the substrate 1 is referred to as the "z direction". The z direction is perpendicular to both of the x direction and the y direction. In the description below, "observed in the z direction" means "observed in the thickness direction".

Figure 4:
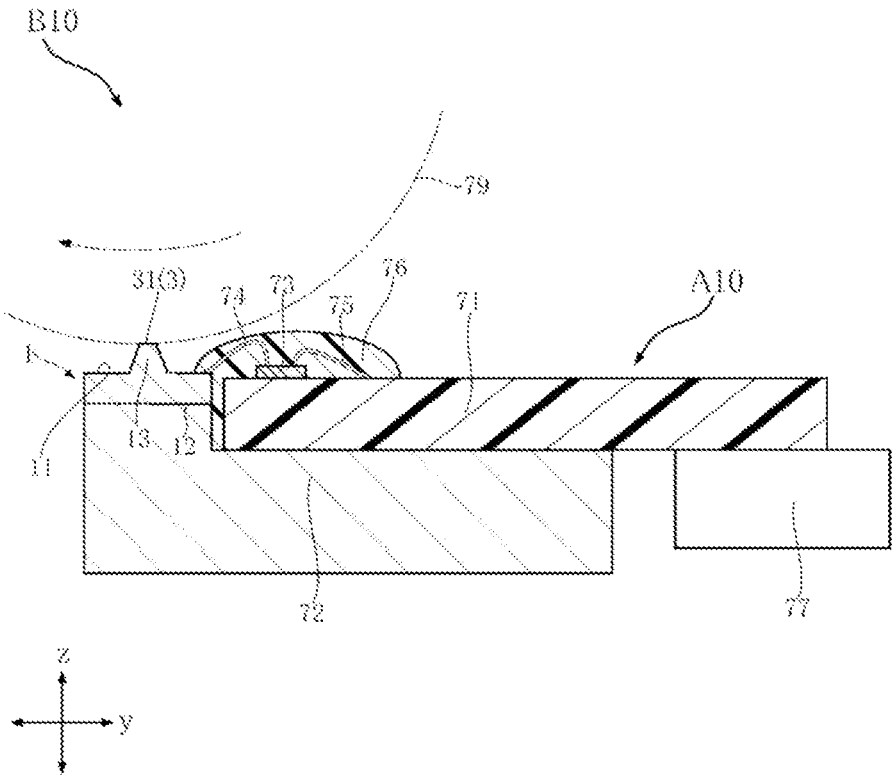
FIG. 4 is a cross-sectional diagram taken along a section line IV-IV in FIG. 1.

In the thermal print head A10, as shown in FIG. 4, the substrate 1 forming the main part of the thermal print head A10 is joined to the heat dissipation member 72. Further, the wiring substrate 71 is located next to the substrate 1 in the y direction. The wiring substrate 71, similar to the substrate 1, is fixed on the heat dissipation member 72. A plurality of heat generating portions 31 are formed on the substrate 1 (with details to be described below), and the plurality of heat generating portions 31 form a part of the resistor layer 3 and are arranged along the x direction. The plurality of heat generating portions 31 selectively generate heat through multiple driving elements 73 mounted on the wiring substrate 71. The multiple driving elements 73 perform driving according to a printing signal sent from the exterior through the connector 77.

Further, as shown in FIG. 4, the thermal printer B10 of the present disclosure includes the thermal print head A10 and a platen roller 79. In the thermal printer B10, the platen roller 79 is a roller mechanism that transports a recording medium such as thermal paper. The recording medium is pressed against the plurality of heat generating portions 31 by the platen roller 79, and the plurality of heat generating portions 31 perform printing on the recording medium. In the thermal printer B10, a non-roller mechanism may be used in substitution for the platen roller 79. The mechanism has a flat surface. Moreover, the flat surface has a curved surface with a smaller curvature. In thermal printer B10, a roller mechanism such as the platen roller 79 and the mechanism are collectively referred to as a "platen".

Figure 1:
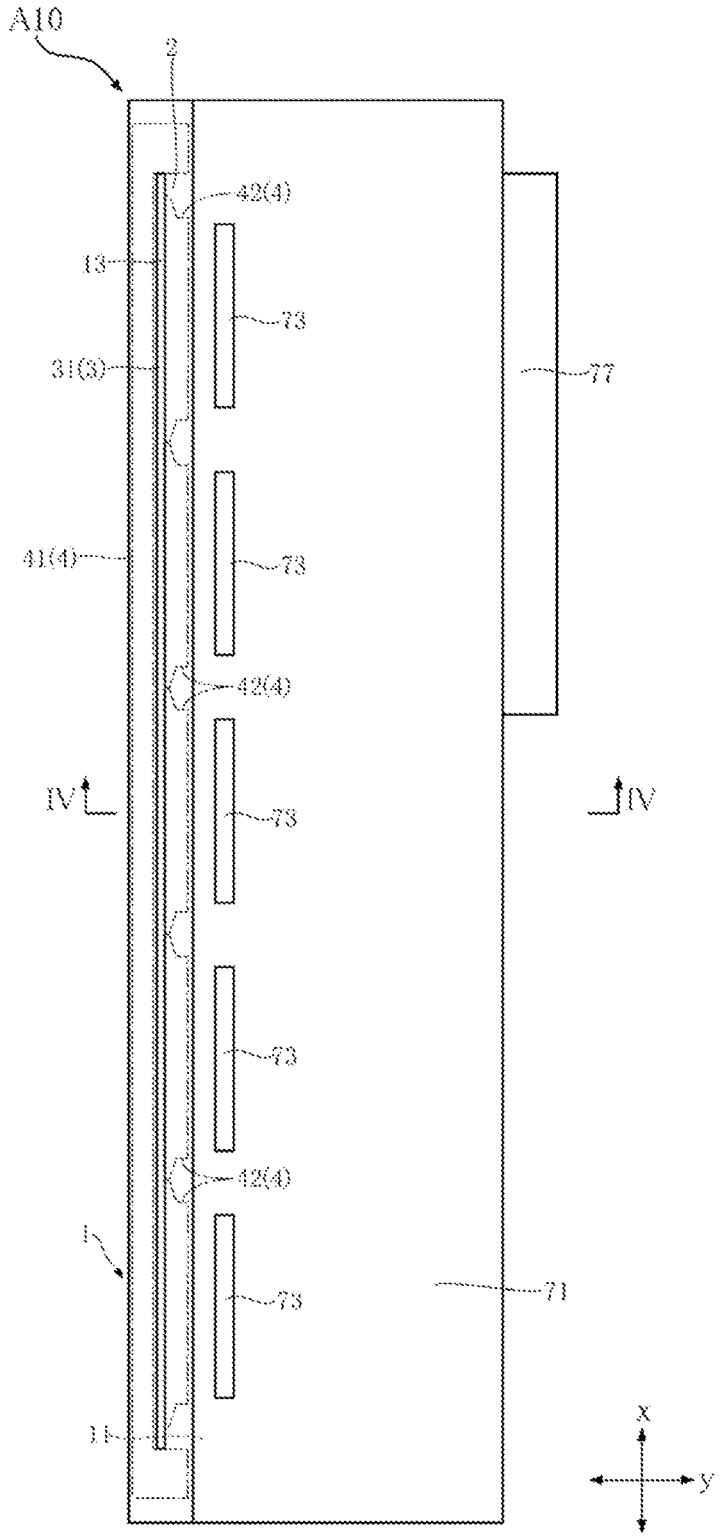
FIG. 1 is a top view of a thermal print head according to a first embodiment of the present disclosure and observed through a protective layer.

As shown in FIG. 1, the substrate 1 is a rectangle extending in the x direction when observed in the z direction. Thus, the x direction is equivalent to a long-side direction of the substrate 1, and they direction is equivalent to a short-side direction of the substrate 1. The substrate 1 is made of a semiconductor material. The semiconductor material includes a monocrystalline material consisting of silicon.

Figure 5:
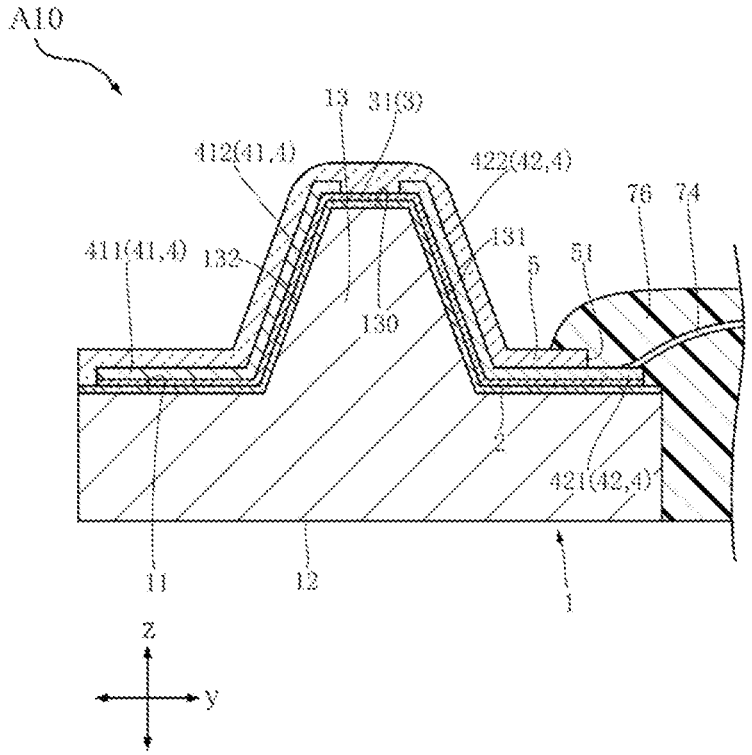
FIG. 5 is a cross-sectional diagram of the main part of the thermal print head in FIG. 1.

As shown in FIG. 5, the substrate 1 has a main surface 11 and a back surface 12 facing opposite to each other in the z direction. The surface orientations of the main surface 11 and the back surface 12 of the crystalline structure of the substrate 1 are both (100) surfaces. As shown in FIG. 4, in the thermal print head A10, the main surface 11 faces the platen roller 79, and the back surface 12 faces the wiring substrate 71.

As shown in FIG. 5, the substrate 1 has a convex portion 13. The convex portion 13 protrudes toward the z direction from the main surface 11. As shown in FIG. 1 and FIG. 2, the convex portion 13 extends in the x direction.

As shown in FIG. 5, the convex portion 13 has a top surface 130, a first inclined surface 131 and a second inclined surface 132. The top surface 130, the first inclined surface 131 and the second inclined surface 132 extend in the x direction. The top surface 130 faces the z direction and is located away from the main surface 11. The top surface 130 is a flat surface that regards the x direction and the y direction as in-plane directions. The first inclined surface 131 and the second inclined surface 132 are disposed between the main surface 11 and the top surface 130 in the z direction, and are separated from each other in the y direction. The first inclined surface 131 and the second inclined surface 132 are inclined with respect to the main surface 11. The first inclined surface 131 and the second inclined surface 132 become closer to each other from the main surface 11 toward the top surface 130.

Figure 6:
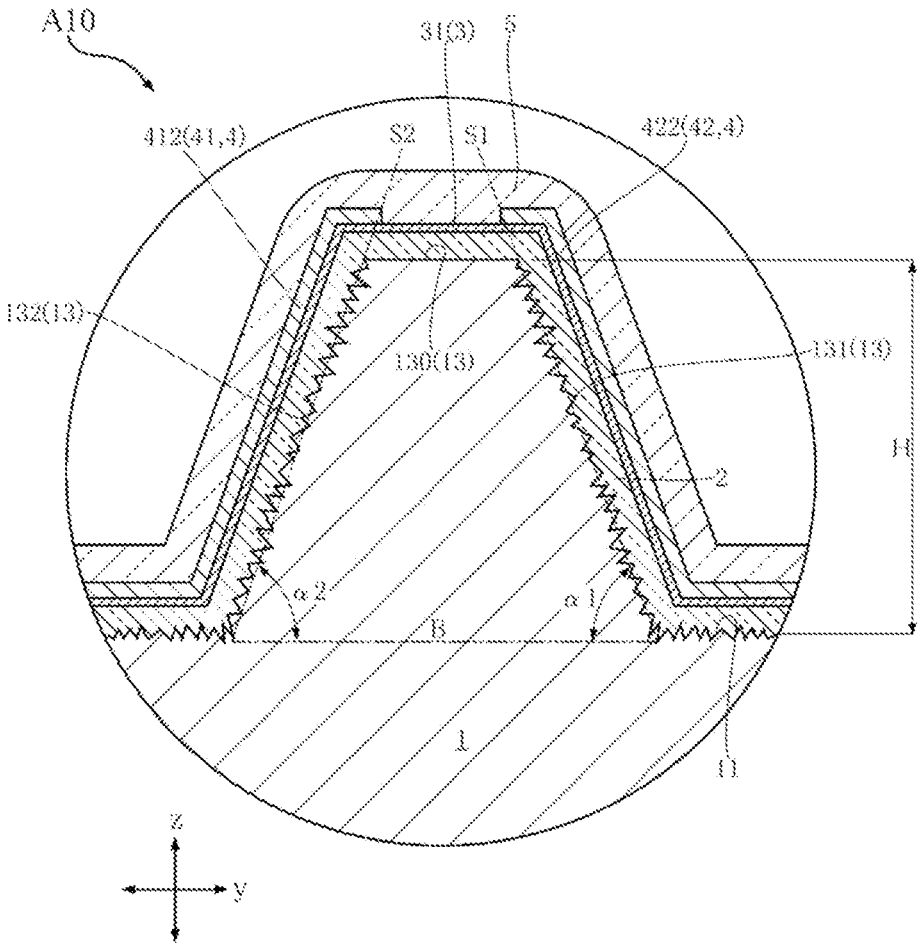
FIG. 6 is a partial enlarged view of FIG. 5.

In FIG. 6, a first titled angle $\alpha 1$ of the first inclined surface 131 with respect to the main surface 11 is more than 55° and less than 88°. The first tilted angle $\alpha 1$ is an acute angle formed by an intersecting angle of an imaginary reference plane B and an imaginary inclined plane S1. The imaginary reference plane B is a plane that regards the x direction and the y direction as in-plane directions. The imaginary reference plane B is parallel to the top surface 130. The imaginary inclined plane S1 is a plane located at two ends of the first inclined surface 131 in the z direction.

In FIG. 6, a second tilted angle α2 of the second inclined surface 132 with respect to the main surface 11 is more than 55° and less than 80°. The second tilted angle α2 is an acute angle formed by an intersecting angle of the imaginary reference plane B and the imaginary inclined plane S2. The imaginary inclined plane S2 is a plane located at two ends of the second inclined surface 132 in the z direction.

As shown in FIG. 6, respective surface roughnesses of the first inclined surface 131 and the second inclined surface 132 are greater than a surface roughness of the top surface 130. Accordingly, a surface roughness of the main surface 11 is also greater than the surface roughness of the top surface 130.

As shown in FIG. 5 and FIG. 6, the insulating layer 2 covers the main surface 11 and the convex portion 13 of the substrate 1. The substrate 1 is electrically insulated from the resistor layer 3 and the wiring layer 4 through the insulating layer 2. The insulating layer 2 includes, for example, silicon dioxide (SiO2) with tetraethoxysilane (TEOS) as the raw material. A thickness of the insulating layer 2 is, for example, 1 μm or more and 15 μm or less.

As shown in FIG. 5 and FIG. 6, the resistor layer 3 is formed on the main surface 11 and the convex portion 13 of the substrate 1. The resistor layer 3 is in contact with the insulating layer 2. Thus, in the thermal print head A10, the insulating layer 2 is sandwiched between the substrate 1 and the resistor layer 3. The resistor layer 3 includes, for example, tantalum nitride (TaN). The thickness of the resistor layer 3 is, for example, 0.02 μm or more and 0.1 μm or less.

As shown in FIG. 2, FIG. 3 and FIG. 6, the resistor layer 3 includes the plurality of heat generating portions 31. In the resistor layer 3, the plurality of heat generating portions 31 are parts exposed from the wiring layer 4. The plurality of heat generating portions 31 are selectively energized from the wiring layer 4, so that the plurality of heat generating portions 31 partially heat the recording medium. The plurality of heat generating portions 31 are arranged in the x direction. Among the plurality of heat generating portions 31, two adjacent heat generating portions 31 in the x direction are located separately from each other. The plurality of heat generating portions 31 are formed to contact the insulating layer 2. In the thermal print head A10, the plurality of heat generating portions 31 are formed over the top surface 130 of the convex portion 13 of the substrate 1. In they direction, the plurality of heat generating portions 31 are located in the center of the top surface 130. As shown in FIG. 4, in the thermal printer B10, the plurality of heat generating portions 31 face the platen roller 79.

As shown in FIG. 5 and FIG. 6, the wiring layer 4 is formed to contact the resistor layer 3. The wiring layer 4 forms a conductive path for supplying electricity to the plurality of heat generating portions 31 of the resistor layer 3. The resistance rate of the wiring layer 4 is less than the resistance rate of the resistor layer 3. The wiring layer 4 is, for example, a metal layer including copper (Cu). The thickness of the wiring layer 4 is, for example, 0.3 μm or more and 2.0 μm or less. Moreover, the wiring layer 4 may be configured as including two metal layers, namely, a titanium (Ti) layer laminated on the resistor layer 3 and a copper layer laminated on the titanium layer. In this case, a thickness of the titanium layer is, for example, 0.1 μm or more and 0.2 μm or less. As shown in FIG. 1, the wiring layer 4 is located away from the periphery of the main surface 11 of the substrate 1.

As shown in FIG. 2, the wiring layer 4 includes a common wire 41 and a plurality of individual wires 42. The common wire 41 is located on one side in they direction relative to the plurality of heat generating portions 31 of the resistor layer 3. The plurality of individual wires 42 are located on one side opposite to the common wire 41 with the plurality of heat generating portions 31 in between in the y direction. As shown in FIG. 3, when observed in the z direction, multiple regions of the resistor layer 3 that are sandwiched between the common wire 41 and the plurality of individual wires 42 are the plurality of heat generating portions 31.

As shown in FIG. 2 and FIG. 3, the common wire 41 includes a base portion 411 and multiple extension portions 412. In the y direction, the base portion 411 is located at a position farthest away from the plurality of heat generating portions 31 of the resistor layer 3. The base portion 411 is a strip extending in the x direction when observed in the z direction. The multiple extension portions 412 are strips extending from an end portion of the base portion 411 facing the convex portion 13 of the substrate 1 in they direction toward the plurality of heat generating portions 31. The multiple extension portions 412 are arranged in the x direction. A part of each of the multiple extension portions 412 is formed on the second inclined surface 132 of the convex portion 13. In the common wire 41, a current flows from the base portion 411 through the multiple extension portions 412 to the plurality of heat generating portions 31.

As shown in FIG. 2 and FIG. 3, each of the individual wires 42 includes a base portion 421 and an extension portion 422. In they direction, the base portion 421 is located at a position farthest away from the plurality of heat generating portions 31 of the resistor layer 3. The base portions 421 of the plurality of individual wires 42 are arranged at equidistant intervals in a staggered manner in the x direction.

As shown in FIG. 2 and FIG. 3, the extension portion 422 is a strip extending from an end portion of the base portion 421 facing the convex portion 13 of the substrate 1 in the y direction toward the plurality of heat generating portions 31. The extension portions 422 of the plurality of individual wires 42 are arranged in the x direction. The respective extension portions 422 of the plurality of individual wires 42 are formed on the first inclined surface 131 of the convex portion 13. In each of the plurality of individual wires 42, a current flows from any of the plurality of heat generating portions 31 through the extension portion 422 to the base portion 421. When observed in the z direction, each of the plurality of heat generating portions 31 is sandwiched between any of the extension portions 422 of the plurality of individual wires 42 and any of the multiple extension portions 412 of the common wire 41. In FIG. 2 and FIG. 3, the configurations of the wiring layer 4 and the plurality of heat generating portions 31 is an example. The configurations of the wiring layer 4 and the plurality of heat generating portions 31 of the present disclosure are not limited to the exemplary configurations shown in FIG. 2 and FIG. 3.

As shown in FIG. 5, the protective layer 5 covers a part of the main surface 11 of the substrate 1, the plurality of heat generating portions 31 of the resistor layer 3 and the wiring layer 4. The protective layer 5 is electrically insulative. The protective layer 5 includes silicon in the composition thereof. The protective layer 5 includes, for example, any of silicon dioxide, silicon nitride ($Si_3N_4$) and silicon carbide (SiC). Alternatively, the protective layer 5 may be a laminated body including multiple substances of the substances above. The thickness of the protective layer 5 is, for example, 1.0 μm or more and 10 μm or less. In the thermal printer B10, the recording medium is pressed by the platen roller 79 shown in FIG. 4 to the region of the protective layer 5 covering the plurality of heat generating portions 31.

As shown in FIG. 5, the protective layer 5 has a wire opening 51. The wire opening 51 passes through the protective layer 5 in the z direction. A part of each of the base portions 421 of the plurality of individual wires 42 and the extension portions 422 of the plurality of individual wires 42 is exposed from the wire opening 51.

As shown in FIG. 4, the wiring substrate 71 is located next to the substrate 1 in they direction. As shown in FIG. 1, the plurality of individual wires 42 are located between the plurality of heat generating portions 31 of the resistor layer 3 and the wiring substrate 71 in they direction, when observed in the z direction. An area of the wiring substrate 71 is greater than an area of the substrate 1, when observed in the z direction. Further, when observed in the z direction, the wiring substrate 71 is a rectangle having the x direction as the long-side direction. The wiring substrate 71 is, for example, a printed circuit board (PCB) substrate. The multiple driving elements 73 and the connector 77 are mounted on the wiring substrate 71.

As shown in FIG. 4, the heat dissipation member 72 faces the back surface 12 of the substrate 1. The back surface 12 is joined to the heat dissipation member 72. The wiring substrate 71 is fixed on the heat dissipation member 72 by fastening members such as screws. During the use of the thermal print head A10, a part of heat energy generated by the plurality of heat generating portions 31 of the resistor layer 3 is transmitted through the substrate 1 to the heat dissipation member 72. The heat transmitted to the heat dissipating member 72 is dissipated to an exterior. The heat dissipation member 72 includes, for example, aluminum (Al).

As shown in FIG. 1 and FIG. 4, the multiple driving elements 73 are mounted on the wiring substrate 71 by an electrically insulative die bonding material (omitted from the drawing). The multiple driving elements 73 are semiconductor devices respectively forming various circuits. Each of the multiple driving elements 73 is bonded to one end of each of the multiple first conducting wires 74 and one end of each of the multiple second conducting wires 75. The other end of each of the multiple first conducting wires 74 is independently bonded to the base portions 421 of the plurality of individual wires 42. The other end of each of the multiple second conducting wires 75 is bonded to a wire (omitted from the drawing), which is provided in the wiring substrate 71 and electrically conducted to the connector 77. Accordingly, a printing signal, a control signal and the voltage supplied to the plurality of heat generating portions 31 of the resistor layer 3 are input to the multiple driving elements 73 through the connector 77. The multiple driving elements 73 have the plurality of individual wires 42 selectively apply a voltage according to these electrical signals. Accordingly, the plurality of heat generating portions 31 selectively generate heat.

As shown in FIG. 4, the sealing resin 76 covers a part of each of the multiple driving elements 73, the multiple first conducting wires 74, the multiple second conducting wires 75, the substrate 1 and the wiring substrate 71. The sealing resin 76 is electrically insulative. The sealing resin 76 is, for example, black and soft composite resin used as an underfill. Moreover, the sealing resin 76 may also be, for example, a black and hard composite resin.

The connector 77 is mounted on one end of the wiring substrate 71 in the y direction, as shown in FIG. 1 and FIG. 4. The connector 77 is connected to the thermal printer B10. The connector 77 has multiple pins (omitted from the drawing). A part of the multiple pins are conducted to wires (omitted from the drawing) bonded with the multiple second conducting wires 75 on the wiring substrate 71. Accordingly, another part of the multiple pins are conducted to wires (omitted from the drawing) on the wiring substrate 71, wherein the wires are conducted to the base portion 411 of the common wire 41.

An example of the method for manufacturing the thermal print head A10 is given on the basis of FIG. 7 to FIG. 15 below. Herein, positions in FIG. 7 and FIG. 10 to FIG. 15 are the same as the position of the main part of the thermal print head A10 in FIG. 5.

Figure 7:
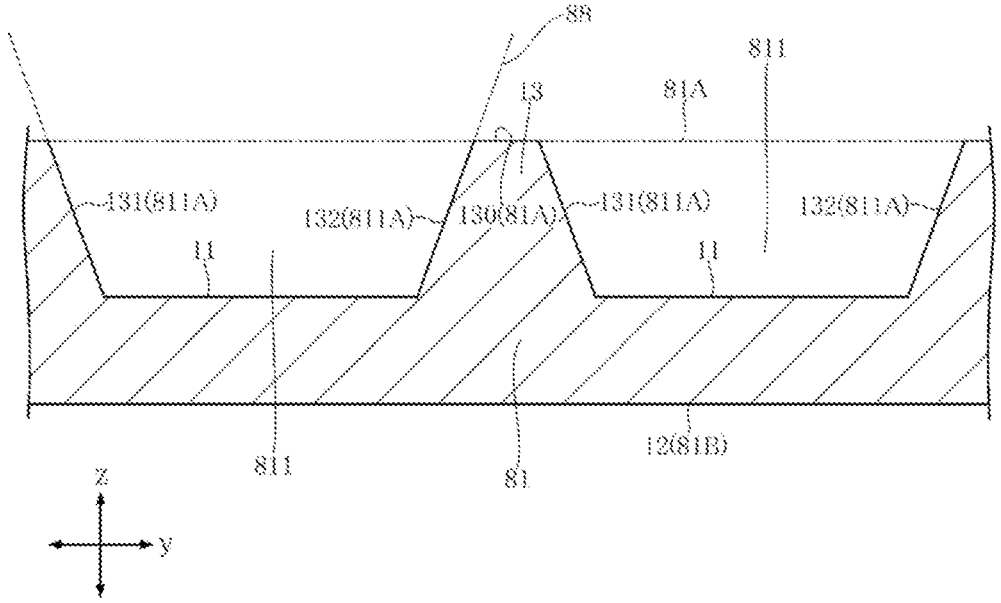
FIG. 7 is a cross-sectional diagram of a manufacturing step for the main part of the thermal print head in FIG. 1.

First of all, as shown in FIG. 7, the main surface 11 and the multiple convex portions 13 are formed on a base material 81. The base material 81 is made of a semiconductor material. The semiconductor material includes a monocrystalline material consisting of silicon. The base material 81 is a silicon wafer. In a direction perpendicular to the z direction, multiple regions formed by respectively connecting equivalent regions of multiple substrates 1 are equivalent to the base material 81. The base material 81 has a first surface 81A and a second surface 81B. The first surface 81A and the second surface 81B face opposite to each other in the z direction. The second surface 81B is equivalent to the back surface 12 of the substrate 1. The surface orientations of the first surface 81A and the second surface 81B of the crystalline structure based on the base material 81 are both (100) surfaces. The main surface 11 faces a same side as the first surface 81A in the z direction, and is located between the first surface 81A and the second surface 81B. The multiple convex portions 13 protrude toward the z direction from the main surface 11, and extend in the x direction. The multiple convex portions 13 are arranged in the y direction.

As shown in FIG. 7, the forming of the main surface 11 and the multiple convex portions 13 on the base material 81 includes forming a plurality of grooves 811 on the base material 81. The plurality of grooves 811 are recessed from the first surface 81A of the base material 81, extend in the x direction and are arranged in the y direction. The plurality of grooves 811 have a pair of first inclined surfaces 811A. The pair of first inclined surfaces 811A are interposed between the main surface 11 and the first surface 81A in the z direction. The pair of first inclined surfaces 811A are separated from each other in they direction. The pair of first inclined surfaces 811A are tilted with respect to the main surface 11 in a direction away from each other from the main surface 11 toward the first surface 81A.

Figure 8:
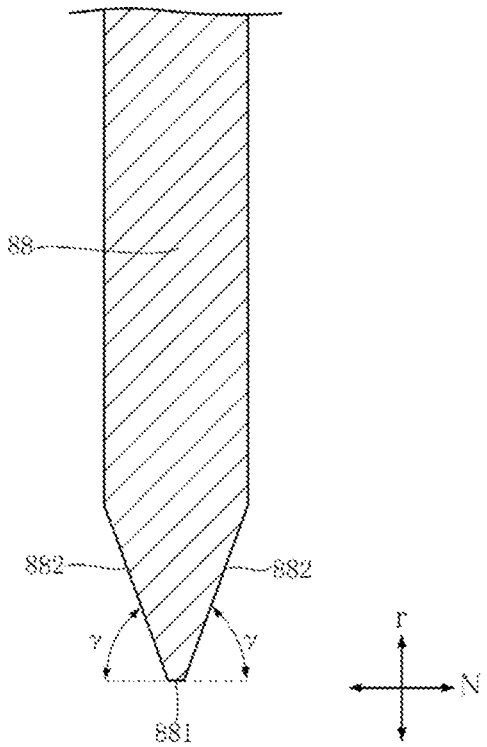
FIG. 8 is a partial enlarged cross-sectional diagram of a blade used for manufacturing the thermal print head in FIG. 1.

As shown in FIG. 7, a portion of the base material 81 is removed by a blade 88 in the forming of the plurality of grooves 811 on the base material 81. The blade 88 presses against the first surface 81A of the base material 81. Accordingly, the plurality of grooves 811 are formed on the base material 81. The blade 88 is a so-called cutting blade. As shown in FIG. 8, the blade 88 has an end face 881 and a pair of tapered surfaces 882. The end face 881 faces a radial direction r of the blade 88. The pair of tapered surfaces 882 are connected to the end face 881, and are separated from each other in a direction N of a rotational axis of the blade 88. The pair of tapered surfaces 882 are inclined with respect to the end face 881 to be separated from each other from the end face 881 toward the rotational axis of the blade 88. An inclination angle $\gamma$ of each of the pair of tapered surfaces 882 with respect to the end face 881 is greater than 55° and less than 80°.

Figure 9:
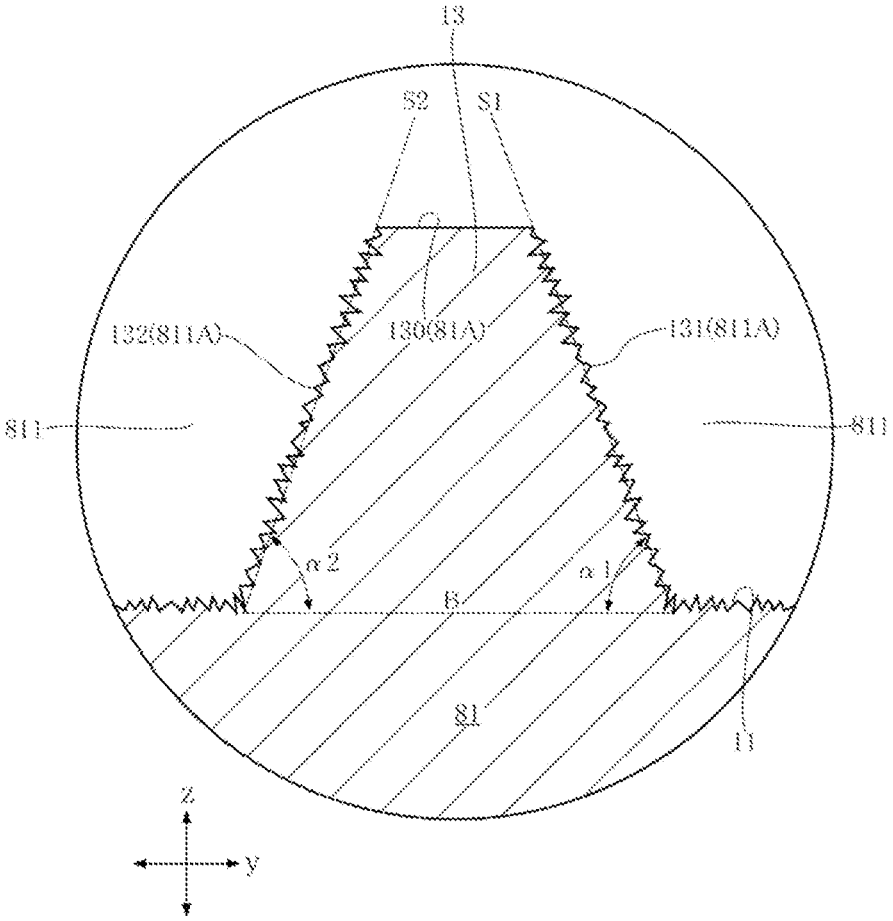
FIG. 9 is a partial enlarged view of FIG. 7.

FIG. 9 shows a state in which the base material 81 has the plurality of grooves 811 formed thereon. By forming the plurality of grooves 811 on the base material 81, the base material 81 having the main surface 11 and the multiple convex portions 13 formed thereon is obtained. One of the pair of first inclined surfaces 811A forms the first inclined surface 131 of any of the multiple convex portions 13. The other of the pair of first inclined surfaces 811A forms the second inclined surface 132 of any of the multiple convex portions 13. The first surface 81A of the base material 81 residual from the forming of the plurality of grooves 811 becomes the top surfaces 130 of the multiple convex portions 13.

Figure 10:
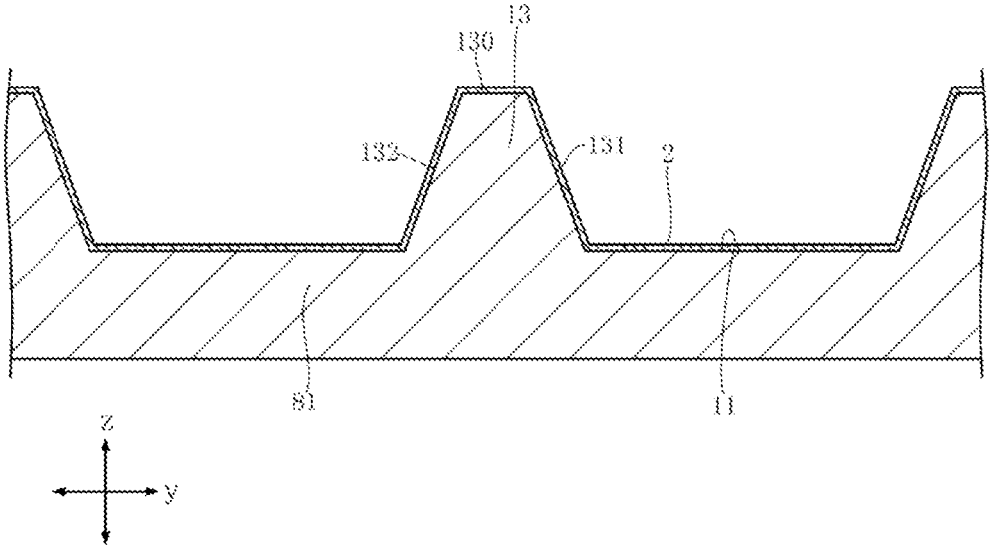
FIG. 10 is a cross-sectional diagram of a manufacturing step for the main part of the thermal print head in FIG. 1.

Next, as shown in FIG. 10, the insulating layer 2 covering the main surface 11 and the multiple convex portions 13 of the base material 81 is formed. The insulating layer 2 is formed by laminating a silicon dioxide film multiple times, wherein the silicon dioxide film is formed by means of plasma-enhanced chemical vapor deposition (CVD) using tetraethoxysilane (TEOS) as the raw material.

Figure 11:
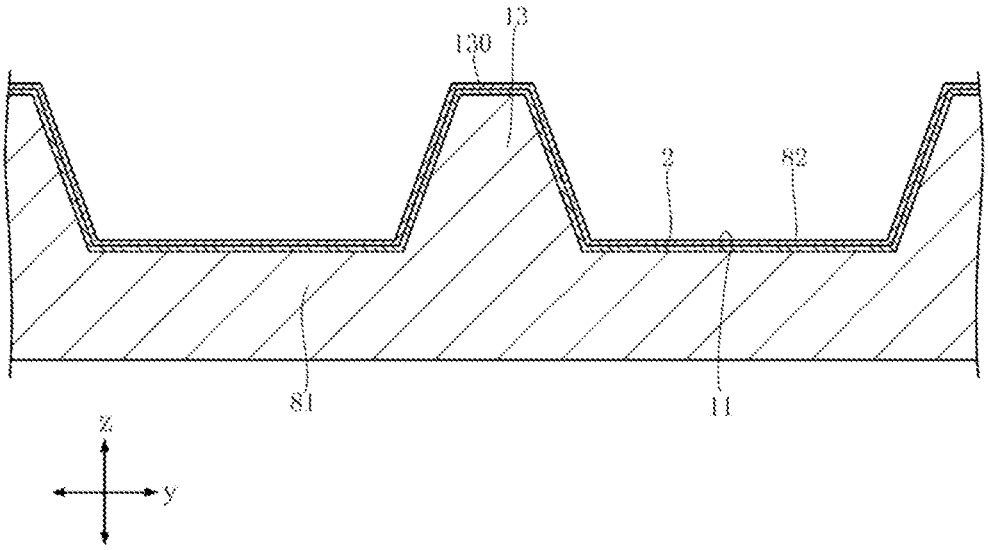
FIG. 11 is a cross-sectional diagram of a manufacturing step for the main part of the thermal print head in FIG. 1.
Figure 12:
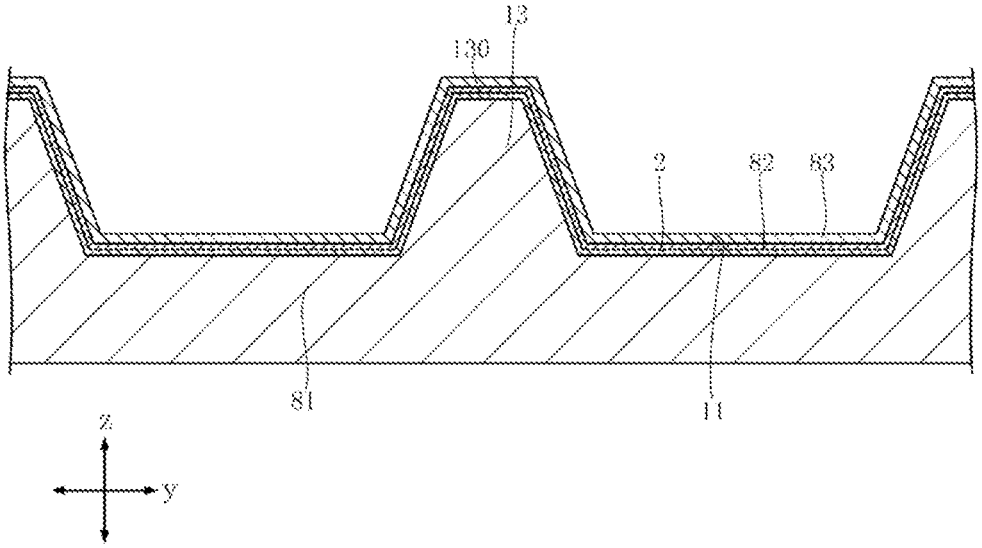
FIG. 12 is a cross-sectional diagram of a manufacturing step for the main part of the thermal print head in FIG. 1.
Figure 13:
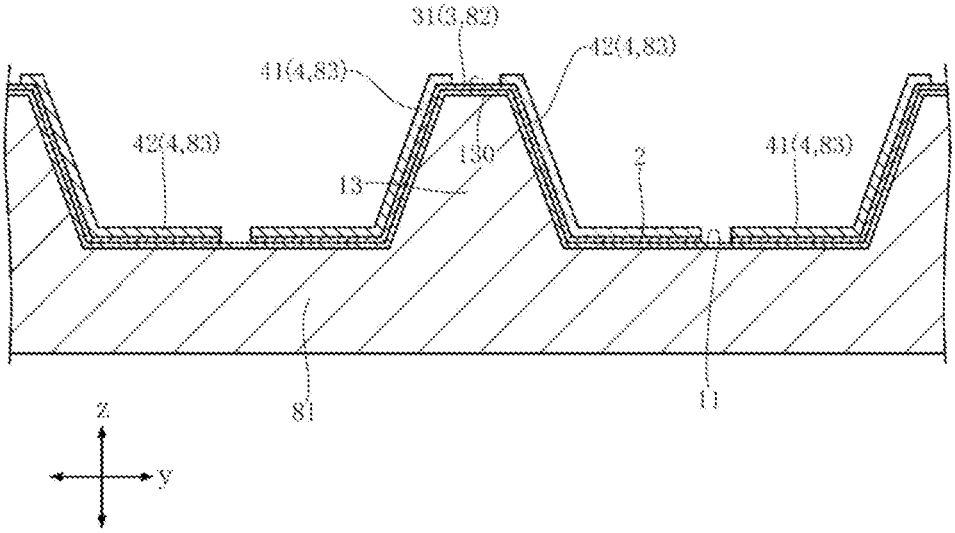
FIG. 13 is a cross-sectional diagram of a manufacturing step for the main part of the thermal print head in FIG. 1.

Next, as shown in FIG. 11 to FIG. 13, the resistor layer 3 and the wiring layer 4 are formed. The resistor layer 3 includes the plurality of heat generating portions 31 arranged in the x direction. The wiring layer 4 is conducted to the plurality of heat generating portions 31. Accordingly, the forming of the wiring layer 4 includes forming the common wire 41 and the plurality of individual wires 42. In the base material 81, the common wire 41 is located on one side in the y direction relative to the plurality of heat generating portions 31 of the resistor layer 3 shown in FIG. 13. In the base material 81, the plurality of individual wires 42 are located on the other side in the y direction relative to the plurality of heat generating portions 31 shown in FIG. 13.

First of all, as shown in FIG. 11, a resistor film 82 is formed on the main surface 11 and the multiple convex portions 13 of the base material 81. The resistor film 82 is formed to cover the entire surface of the insulating layer 2. The resistor film 82 is formed by laminating a tantalum nitride film over the insulating layer 2 by means of sputtering.

Next, as shown in FIG. 12, a conductive layer 83 covering the entire surface of the resistor film 82 is formed. The conductive layer 83 is formed on the resistor film 82 by laminating a copper film multiple times by means of sputtering. In addition, the following method may also be adopted, that is, when the conductive film 83 is formed, after laminating a titanium film on the resistor film 82 by means of sputtering, a copper film is laminated multiple times on the titanium film by means of sputtering.

Next, as shown in FIG. 13, a part of the conductive layer 83 is removed after performing lithography patterning on the conductive layer 83. The removing is performed by means of wet etching using a mixed solution of sulphuric acid ($H_2SO_4$) and hydrogen peroxide ($H_2O_2$). Accordingly, the common wire 41 and the plurality of individual wires 42 are formed to contact the resistor film 82. Moreover, a region of the resistor film 82 formed on the top surface 130 of the multiple convex portions 13 of the base material 81 is exposed from the wiring layer 4. Then, a part of the resistor film 82 is removed after lithography patterning is performed on the resistor film 82 and the wiring layer 4. The removing is performed by means of reactive ion etching (RIE). Accordingly, the resistor film 3 is formed on the main surface 11 and the multiple convex portions 13 of the base material 81. The plurality of heat generating portions 31 are shown over the top surface 130 of the base material 81.

Figure 14:
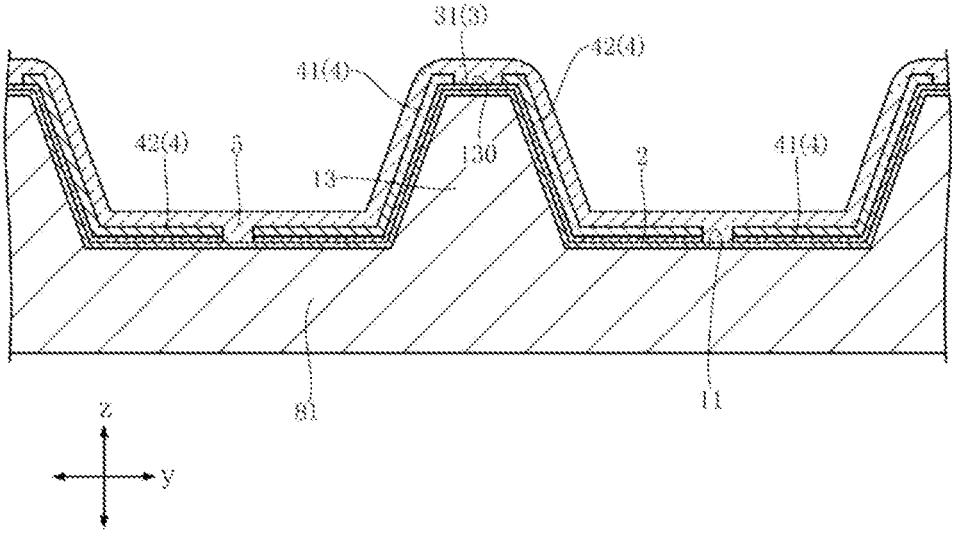
FIG. 14 is a cross-sectional diagram of a manufacturing step for the main part of the thermal print head in FIG. 1.

As shown in FIG. 14, the protective layer 5 covering a part of the main surface 11 of the base material 81, the plurality of heat generating portions 31 of the resistor layer 3 and the wiring layer 4 is formed. The protective layer 5 is formed by laminating a silicon nitride film by means of plasma-enhanced CVD.

Figure 15:
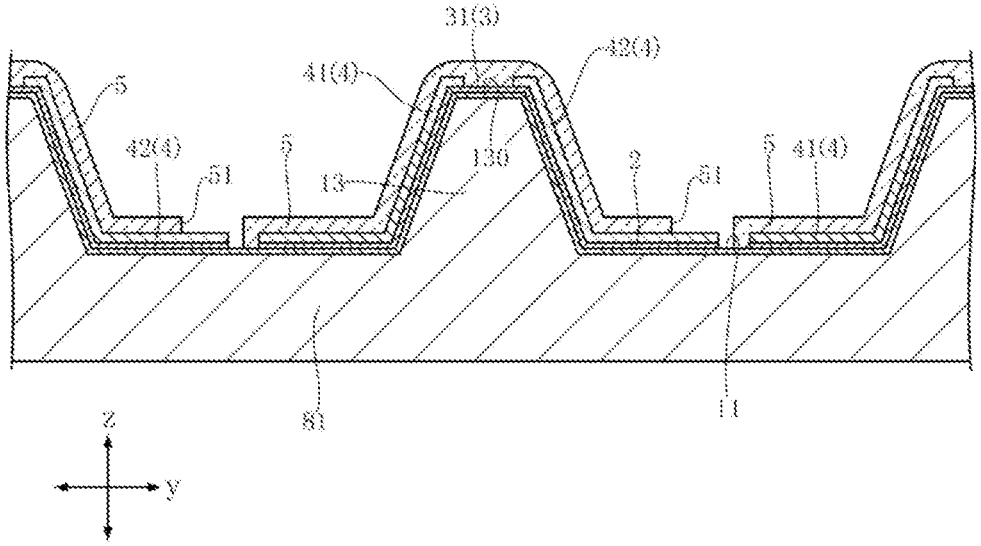
FIG. 15 is a cross-sectional diagram of a manufacturing step for the main part of the thermal print head in FIG. 1.

Next, as shown in FIG. 15, the wire opening 51 passing through in the z direction is formed in the protective layer 5. The wire opening 51 is formed by removing a part of the protective layer 5 after lithography patterning is performed on the protective layer 5. The removing is performed by means of reactive ion etching (RIE). Accordingly, a part of the plurality of individual wires 42 (a part of each of the base portions 421 of the plurality of individual wires 42 and the extension portions 422 of the plurality of individual wires 42 shown in FIG. 5) is exposed from the wire opening 51. The part serving as a part of each of the plurality of individual wires 42 and exposed from the wire opening 51 forms the base portion 421 to which the multiple first conducting wires 74 are individually bonded by wire bonding, for example. A metal layer such as gold may be laminated by plating on each part (including the base portion 421) of the plurality of individual wires 42 exposed from the wire opening 51.

Next, the base material 81 is cut along the x direction and the y direction. Accordingly, the chip obtained that becomes the main part of the thermal print head A10 including the substrate 1 can be obtained. A cutting device for the base material 81 is, for example, a cutting machine. A cut line of the base material 81 is set at a position away from the resistor layer 3 and the wiring layer 4.

Next, the multiple driving elements 73 and the connector 77 are mounted on the wiring substrate 71. Then, the back surface 12 of the substrate 1 and the wiring substrate 71 are joined to the heat dissipation member 72. Next, the multiple first conducting wires 74 and the multiple second conducting wires 75 are joined to the wiring substrate 71. Lastly, the sealing resin 76 covering the driving elements 73, the multiple first conducting wires 74 and the multiple second conducting wires 75 is formed on the substrate 1 and the wiring substrate 71. The thermal print head A10 is obtained through the steps above.

Variation Example of the First Embodiment

Figure 16:
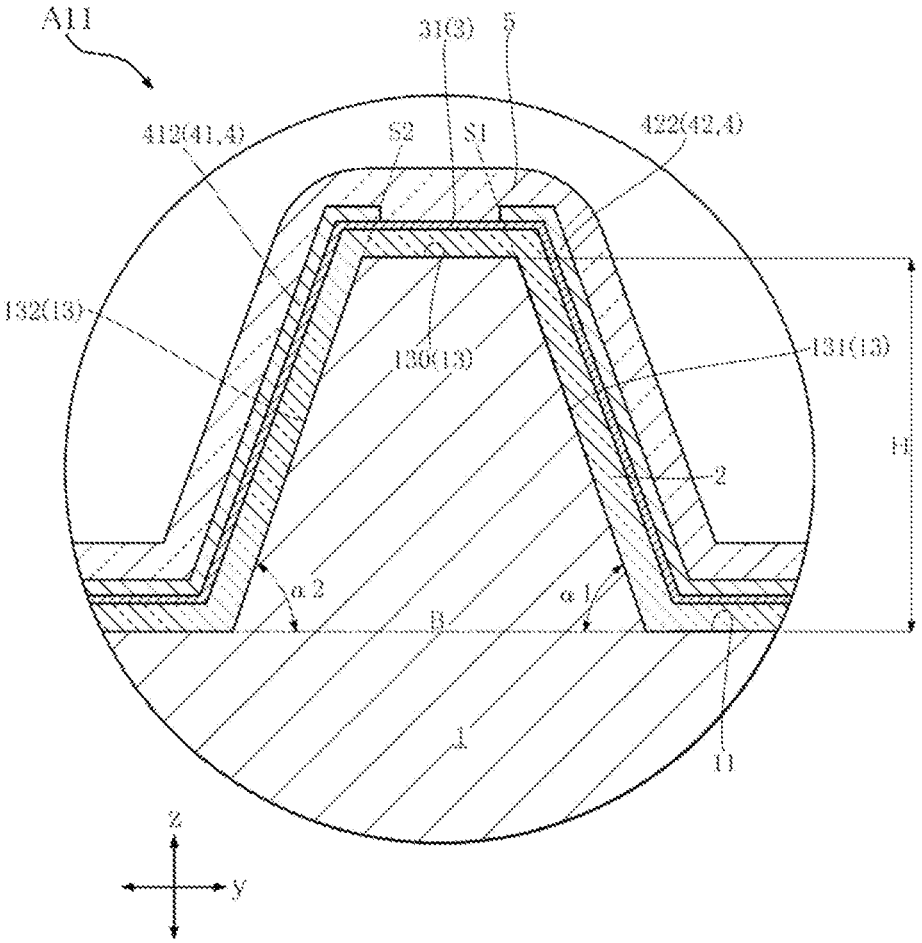
FIG. 16 is a partial enlarged sectional diagram of a main part of a variation example of the thermal print head in FIG. 1.

A thermal print head A11 as a variation example of the thermal print head A10 is described on the basis of FIG. 16 below. Herein, a corresponding position in FIG. 16 is the same as the position of the main part of the thermal print head A10 in FIG. 6.

In the thermal print head A11, the configurations of the main surface 11 and the convex portion 13 of the substrate 1 are different from the configurations of those in the thermal print head A10. As shown in FIG. 16, respective surface roughnesses of the main surface 11 and the first inclined surface 131 and the second inclined surface 130 of the convex portion 13 are the same as the surface roughness of the top surface 130 of the convex portion 13. That is, the main surface 11, the first inclined surface 131 and the second inclined surface 132 are all flat surfaces. This configuration is obtained by adjusting conditions for forming the film serving as a basis of the insulating layer 2 when plasma-enhanced CVD is used in the forming of the insulating layer 2 shown in FIG. 10 in the method for manufacturing the thermal print head A10 described above. When the respective surface roughnesses of the main surface 11, the first inclined surface 131 and the second inclined surface 132 are large, the respective surface roughnesses of these surfaces can be reduced in advance by means of wet etching using such as a potassium hydroxide (KOH) solution used in a previous step of the step shown in FIG. 10.

Next, effects of the thermal print head A10 are given below.

The thermal print head A10 includes the substrate 1, which has the main surface 11 and the convex portion 13 and is made of a semiconductor material. The convex portion 13 has the top surface 130, the first inclined surface 131 and the second inclined surface 132. The first inclined surface 131 and the second inclined surface 132 are disposed between the main surface 11 and the top surface 130, and are tilted with respect to the main surface 11. A first tilted angle α1 of the first inclined surface 131 with respect to the main surface 11 and a second tilted angle α2 of the second inclined surface 132 with respect to the main surface 11 are greater than 55°.

This configuration is obtained by the following method, that is, in the forming of the main surface 11 and the convex portion 13 on the base material 81 of the manufacturing steps of the thermal print head A10, a portion of the base material 81 is removed by the blade 88 so as to form the plurality of grooves 811 on the base material 81. With this manufacturing method, compared to the situation in which the plurality of grooves 811 are formed by means of wet etching using such as a KOH solution, the plurality of grooves 811 can be more efficiently formed within a shorter period of time. Thus, a height H of the convex portion 13 shown in FIG. 6 can be set to be higher, hence preventing the platen roller 79 shown in FIG. 4 from interference with the thermal print head A10. Thus, according to the thermal print head A10, enhanced printing quality can be achieved and interference from the platen roller 79 can be prevented.

The first tilted angle α1 of the first inclined surface 131 and the second tilted angle α2 of the second inclined surface 132 are less than 80°. Accordingly, sharpening of contact of the thermal print head A10 on the recording medium in the z direction can be inhibited. Therefore, damage of the recording medium can be prevented.

The respective surface roughnesses of the first inclined surface 131 and the second inclined surface 132 are greater than the surface roughness of the top surface 130. Accordingly, the surface roughness of the main surface 11 of the substrate 1 is greater than the surface roughness of the top surface 130. This configuration is traces that appear when a portion of the base material 81 is removed by the blade 88 so as to form the plurality of grooves 811 on the base material 81 in the manufacturing of the thermal print head A10.

The thermal print head A10 further includes the insulating layer 2 covering the main surface 11 and the convex portion 13 of the substrate 1. The insulating layer 2 is interposed between the substrate 1 and the resistor layer 3. Accordingly, even if the respective surface roughnesses of the main surface 11, the first inclined surface 131 and the second inclined surface 132 are large, the surface of the insulating layer 2 is relatively smooth so that the thickness of the resistor layer 3 can be uniform. Thus, resistance variations in the resistor layer 3 can be inhibited. As a result, the insulating layer 2 exhibits an anchor effect with respect to the substrate 1. Therefore, the bonding strength of the insulating layer 2 with respect to the substrate 1 can be enhanced.

The semiconductor material included in the substrate 1 is a monocrystalline material consisting of silicon. Accordingly, heat conductivity of the substrate 1 is relatively large (approximately 170 W/(m·k)), and costs of the substrate 1 can be reduced.

The thermal print head A10 further includes the protective layer 5 covering the plurality of heat generating portions 31 of the resistor layer 3 and the wiring layer 4. Accordingly, by protecting the plurality of heat generating portions 31 and the wiring layer 4 by the protective layer 5, the contact of the recording medium with respect to the thermal print head A10 becomes smoother during the use of the thermal print head A10.

The thermal print head A10 further includes the heat dissipation member 72. The back surface 12 of the substrate 1 is joined to the heat dissipation member 72. Accordingly, during the use of the thermal print head A10, a part of heat energy dissipated from the plurality of heat generating portions 31 is rapidly released to the exterior through the substrate 1 and the heat dissipation member 72.

Second Embodiment

On the basis of FIG. 17 to FIG. 18, a thermal print head A20 according to a second embodiment of the present disclosure is described below. In these drawings, elements the same as or similar to those of the thermal print head A10 described above are provided with the same numerals and denotations, and repeated description is omitted. Herein, a corresponding position in FIG. 17 is the same as the position of the main part of the thermal print head A10 in FIG. 5.

In the thermal print head A20, the configuration of the convex portion 13 of the substrate 1 and the configuration of the plurality of heat generating portions 31 of the resistor layer 3 are different from the corresponding configurations in the thermal print head A10 described above.

Figure 17:
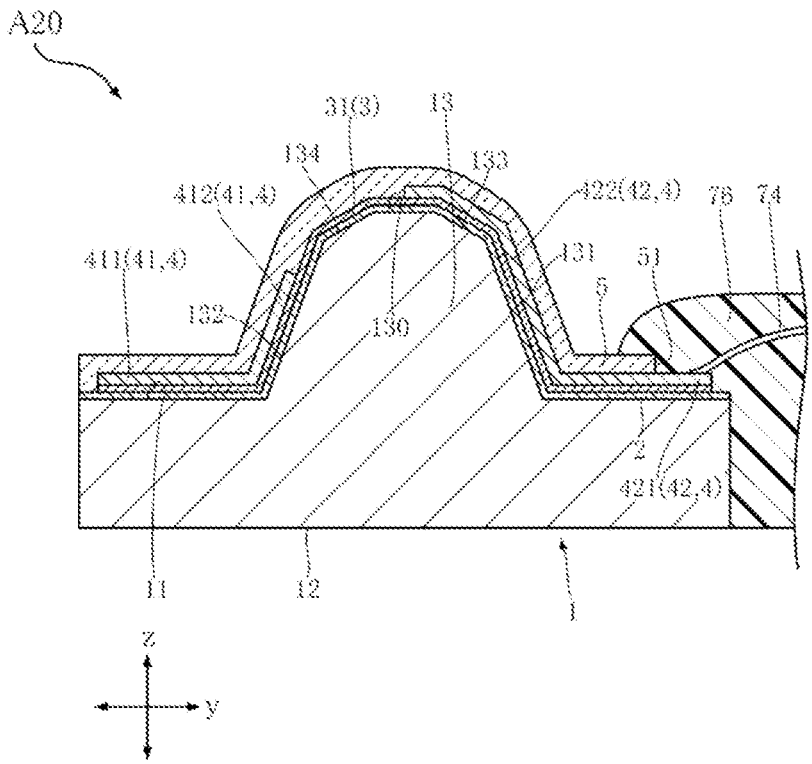
FIG. 17 is a cross-sectional diagram of a main part of a thermal print head according to a second embodiment of the present disclosure.

As shown in FIG. 17, the convex portion 13 has a third inclined surface 133. The third inclined surface 133 is located on the same side as the first inclined surface 131 with respect to the top surface 130 in the y direction, and is disposed between the first inclined surface 131 and the top surface 130 in the z direction. The third inclined surface 133 is tilted with respect to the main surface 11. As shown in FIG. 18, a third tilted angle α3 of the third inclined surface 133 with respect to the main surface 11 is less than the first tilted angle α1. The third tilted angle α3 is an acute angle formed by an intersecting angle of the imaginary reference plane B and the third inclined surface 133.

Figure 18:
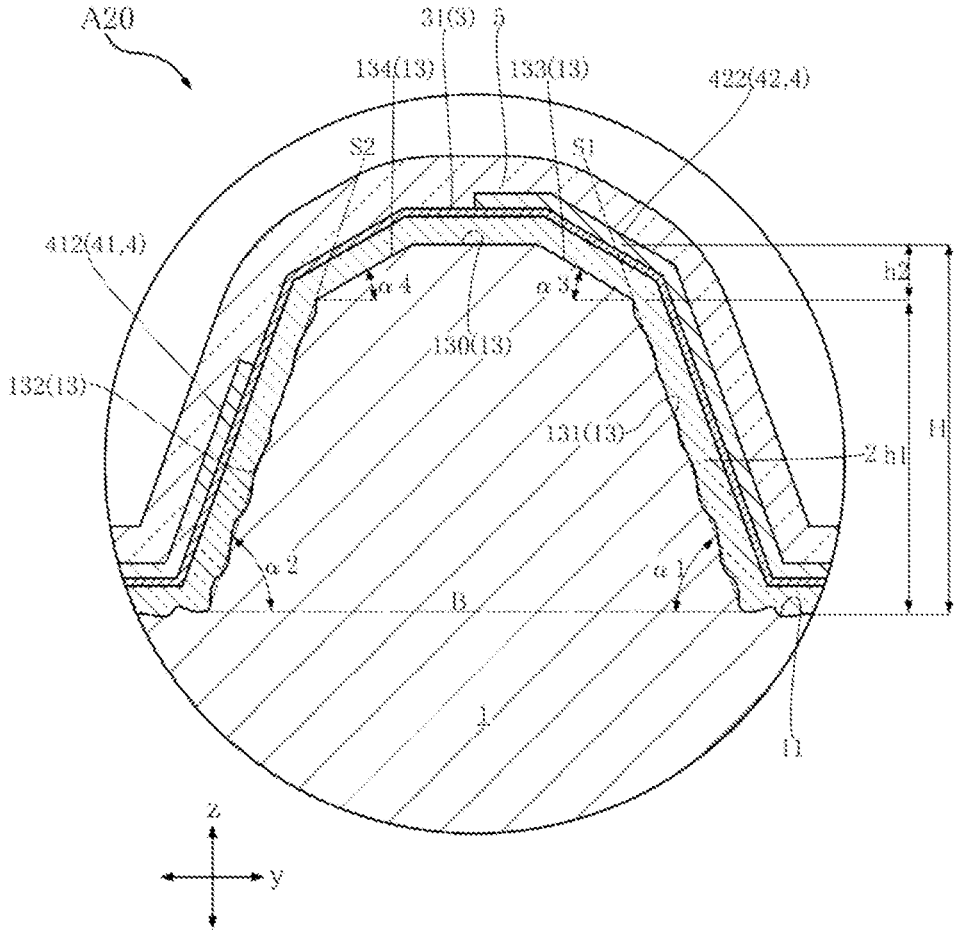
FIG. 18 is a partial enlarged view of FIG. 17.

As shown in FIG. 18, the surface roughness of the first inclined surface 131 is greater than a surface roughness of the third inclined surface 133. However, the surface roughness of the first inclined surface 131 is less than the surface roughness of the first inclined surface 131 of the convex portion 13 of the thermal print head A10. A dimension h1 of the first inclined surface 131 in the z direction is more than a dimension h2 of the third inclined surface 133 in the z direction.

As shown in FIG. 17, the convex portion 13 has a fourth inclined surface 134. The fourth inclined surface 134 is located on one side opposite to the third inclined surface 133 with the top surface 130 in between in the y direction, and is disposed between the second inclined surface 132 and the top surface 130 in the z direction. The fourth inclined surface 134 is tilted with respect to the main surface 11. The third inclined surface 133 and the fourth inclined surface 134 become closer to each other from the first inclined surface 131 and the second inclined surface 132 toward the top surface 130. As shown in FIG. 18, a fourth tilted angle α4 of the fourth inclined surface 134 with respect to the main surface 11 is less than the second tilted angle α2. The fourth tilted angle α4 is an acute angle formed by an intersecting angle of the imaginary reference plane B and the fourth inclined surface 134.

As shown in FIG. 18, the surface roughness of the second inclined surface 132 is greater than a surface roughness of the fourth inclined surface 134. However, the surface roughness of the second inclined surface 132 is less than the surface roughness of the second inclined surface 132 of the convex portion 13 of the thermal print head A10. Accordingly, the surface roughness of the main surface 11 is less than the surface roughness of the main surface 11 of the thermal print head A10.

As shown in FIG. 18, the plurality of heat generating portions 31 of the resistor layer 3 are formed on the top surface 130, the fourth inclined surface 134 and the second inclined surface 132 of the convex portion 13. In addition, the plurality of heat generating portions 31 may also be configured to be formed on the top surface 130, the third inclined surface 133 and the first inclined surface 131 of the convex portion 13.

An example of a method for manufacturing the thermal print head A20 is given on the basis of FIG. 19 to FIG. 24 below. Herein, corresponding positions in FIG. 19 to FIG. 22 are the same as the position of the main part of the thermal print head A10 in FIG. 5.

Figure 19:
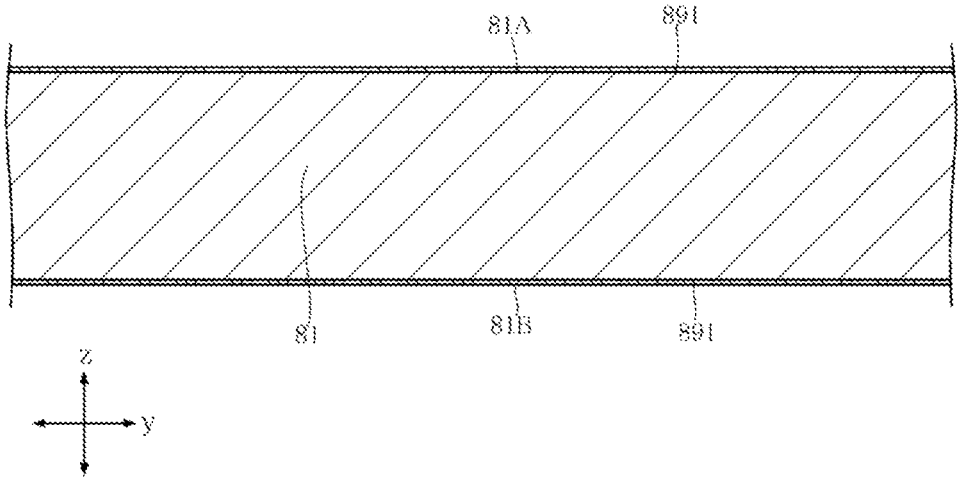
FIG. 19 is a cross-sectional diagram of a manufacturing step for the main part of the thermal print head in FIG. 17.
Figure 20:
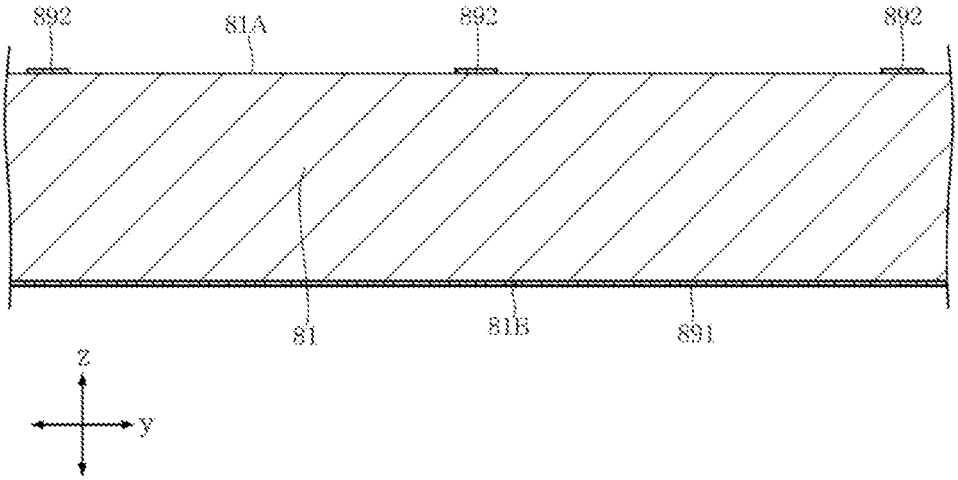
FIG. 20 is a cross-sectional diagram of a manufacturing step for the main part of the thermal print head in FIG. 17.

In the manufacturing steps of the thermal print head A20, the forming of the main surface 11 and the multiple convex portions 13 on the base material 81 includes, before the forming of the plurality of grooves 811 on the base material 81, forming a first mask layer 891 and multiple second mask layers 892 on the base material 81 shown in FIG. 19 and FIG. 20. However, the forming of the first mask layer 891 and the multiple second mask layers 892 can also be omitted. Further, the forming of the main surface 11 and the multiple convex portions 13 on the base material 81 includes, after the forming of the plurality of grooves 811 on the base material 81, forming a pair of second inclined surfaces 811B in two adjacent grooves 811 among the plurality of grooves 811 shown in FIG. 22.

First of all, as shown in FIG. 19, the first mask layer 891 covering the first surface 81A and the second surface 81B of the base material 81 is formed. To form the first mask layer 891, either of a silicon nitride film and a silicon dioxide film covering the entire surface of the base material 81 is formed by means of plasma-enhanced CVD.

Next, as shown in FIG. 20, the multiple second mask layers 892 covering the first surface 81A of the base material 81 are formed. The multiple second mask layers 892 are formed by implementing lithography patterning and reactive ion etching (RIE) on the first mask layer 891 covering the first surface 81A and thus removing a portion of the first mask layer 891. Accordingly, the multiple second mask layers 892 are formed. The multiple second mask layers 892 extend in the x direction and are arranged along the y direction.

Figure 21:
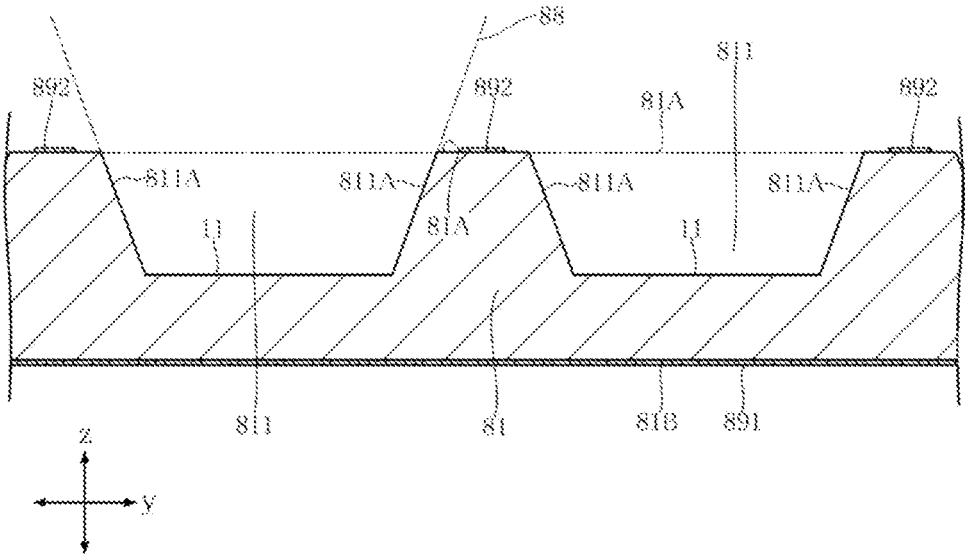
FIG. 21 is a cross-sectional diagram of a manufacturing step for the main part of the thermal print head in FIG. 17.
Figure 23:
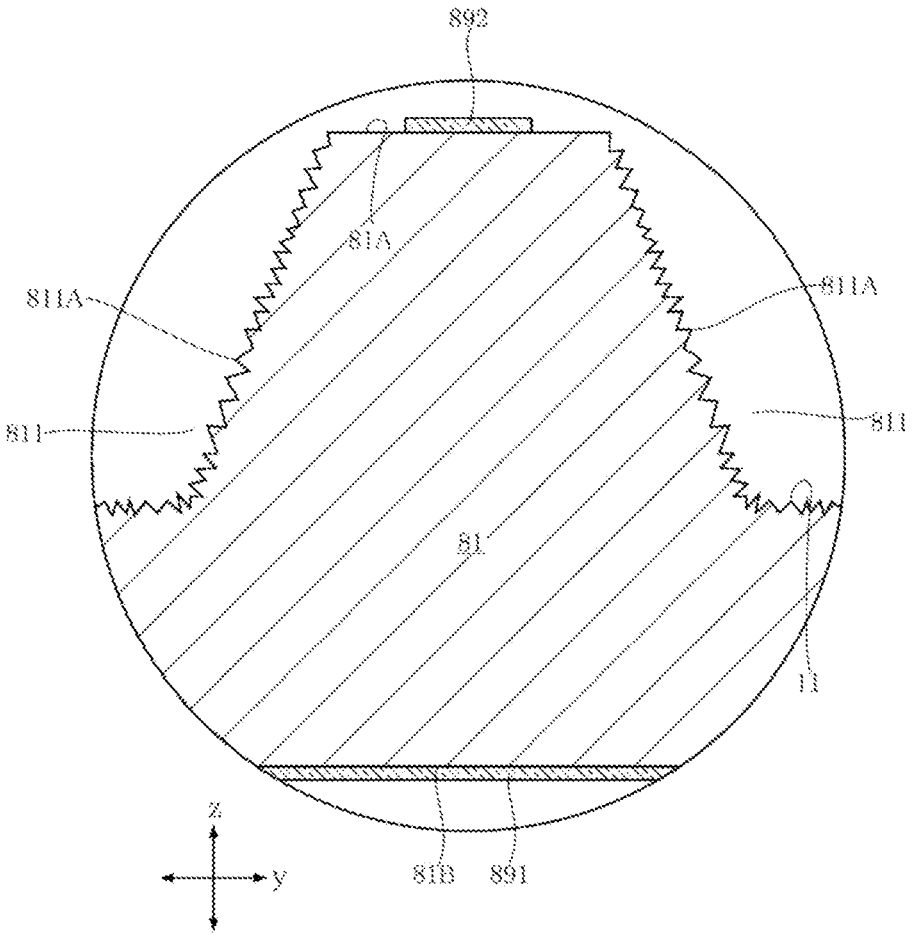
FIG. 23 is a partial enlarged view of FIG. 21.

Next, as shown in FIG. 21, the plurality of grooves 811 are formed on the base material 81. In this step, any of the plurality of grooves 811 is formed between two adjacent second mask layers 892 among the multiple second mask layers 892. When the plurality of grooves 811 are formed, the blade 88 does not come into contact with the multiple second mask layers 892. FIG. 23 shows a state in which the base material 81 has the plurality of grooves 811 formed thereon.

Figure 22:
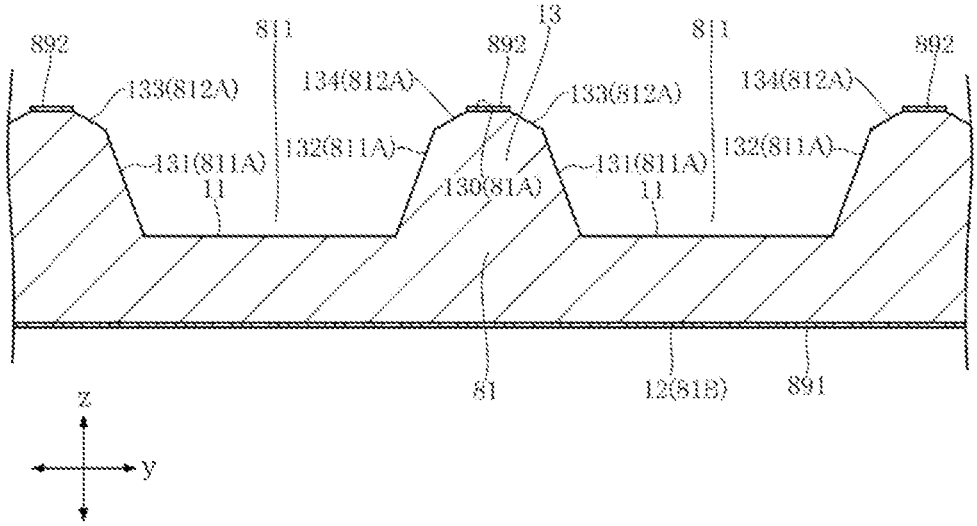
FIG. 22 is a cross-sectional diagram of a manufacturing step for the main part of the thermal print head in FIG. 17.

Next, as shown in FIG. 22, a pair of second inclined surfaces 811B are formed in two adjacent grooves 811 among the plurality of grooves 811. The pair of second inclined surfaces 811B are formed by means of wet etching using a tetramethylammonium hydroxide (TMAH) aqueous solution on a boundary between a pair of first inclined surfaces 811A of the plurality of grooves 811 and the first surface 81A. The pair of second inclined surfaces 811B are interposed between a pair of first inclined surfaces 811A and the first surface 81A in the z direction. The pair of second inclined surfaces 811B are tilted with respect to the main surface 11 in a direction close to each other from the pair of first inclined surface 811A toward the first surface 81A.

Figure 24:
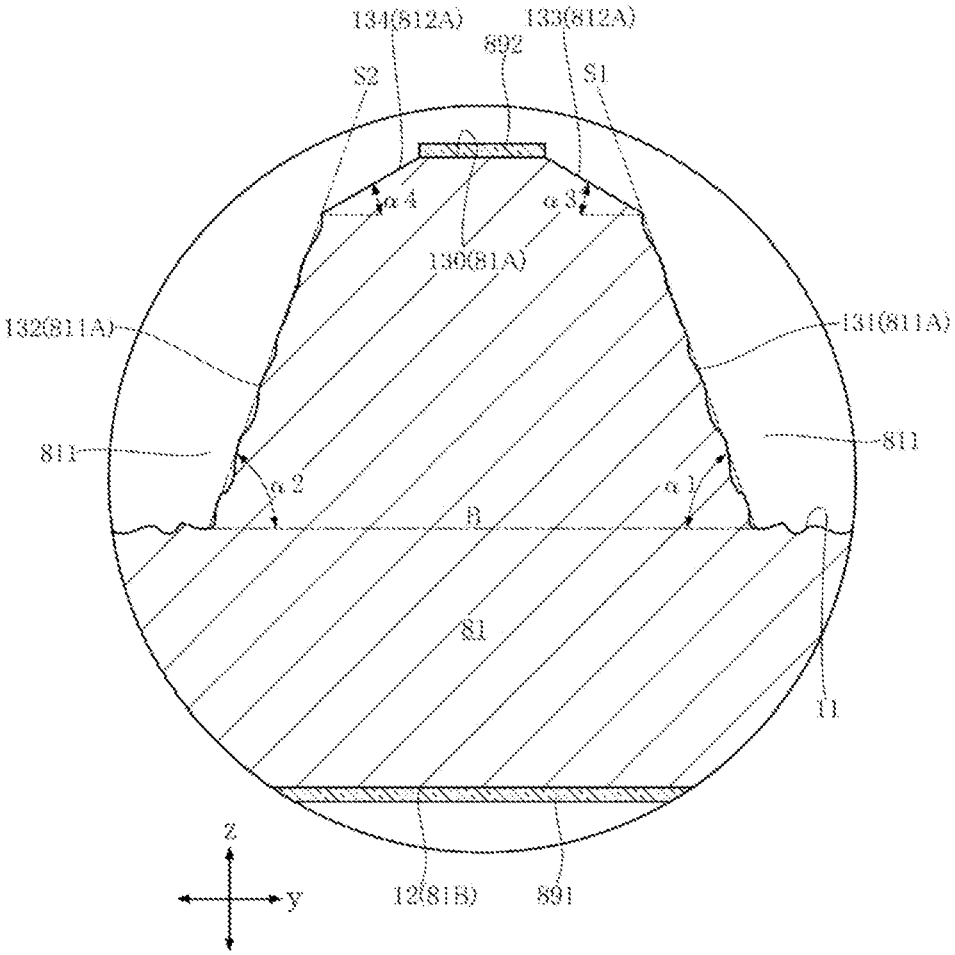
FIG. 24 is a partial enlarged view of FIG. 22.

FIG. 24 shows a state of the base material 81 in which a pair of second inclined surfaces 811B are formed in two adjacent grooves 811 among the plurality of grooves 811. By forming a pair of second inclined surface 811B, the base material 81 having the main surface 11 and the multiple convex portions 13 formed thereon is obtained. One second inclined surface 811B of a pair of second inclined surfaces 811B forms the third inclined surface 133 of any of the multiple convex portions 13. The other second inclined surface 811B of the pair of second inclined surfaces 811B forms the fourth inclined surface 134 of any of the multiple convex portions 13. To form a pair of second inclined surfaces 811B, wet etching is implemented on both of the main surface 11 and a pair of first inclined surfaces 811A of the plurality of grooves 811. Accordingly, the respective surface roughnesses of the main surface 11, and the first inclined surface 131 and the second inclined surface 132 of the convex portion 13 in the thermal print head A20 are all less than the surface roughnesses of these surfaces in the thermal print head A10.

After the main surface 11 and the multiple convex portions 13 are formed on the base material 81, the first mask layer 891 and the multiple second mask layers 892 are removed. These mask layers are removed by means of wet etching using hydrofluoric (HF) acid.

Subsequent steps associated with the manufacturing of the thermal print head A20 are the same as the manufacturing steps of the thermal print head A10 shown in FIG. 10 to FIG. 15. The thermal print head A20 is obtained through the steps above.

Next, effects of the thermal print head A20 are given below.

The thermal print head A20 includes the substrate 1, which has the main surface 11 and the convex portion 13 and is made of a semiconductor material. The convex portion 13 has the top surface 130, the first inclined surface 131 and the second inclined surface 132. The first inclined surface 131 and the second inclined surface 132 are disposed between the main surface 11 and the top surface 130, and are tilted with respect to the main surface 11. The first tilted angle $\alpha 1$ of the first inclined surface 131 with respect to the main surface 11 and the second tilted angle $\alpha 2$ of the second inclined surface 132 with respect to the main surface 11 are greater than 55°. Thus, the thermal print head A20 is also capable of achieving enhanced printing quality and preventing interference from the platen roller 79. Therefore, the thermal print head A20 functions to provide the same effects and results equivalent to the thermal print head A10 with the common configuration as the thermal print head A10.

The thermal print head A20 has the third inclined surface 133 and the fourth inclined surface 134. The third inclined surface 133 and the fourth inclined surface 134 are respectively disposed between the first inclined surface 131 and the top surface 130 and between the second inclined surface 132 and the top surface 130, and tilted with respect to the main surface 11. The third tilted angle $\alpha 3$ of the third inclined surface 133 with respect to the main surface 11 is less than the first tilted angle $\alpha 1$ of the first inclined surface 131. The fourth tilted angle $\alpha 4$ of the fourth inclined surface 134 with respect to the main surface 11 is less than the second tilted angle α2 of the second inclined surface 132. With the configuration above, the shape of a part of the wiring layer 4 formed along the convex portion 13 becomes smoother. Moreover, in the wiring layer 4 formed along the convex portion 13, occurrences of damage and breaking of wiring patterns are inhibited.

Third Embodiment

On the basis of FIG. 25, a thermal print head A30 according to a third embodiment of the present disclosure is described below. In this drawing, elements the same as or similar to those of the thermal print head A10 described above are provided with the same numerals and denotations, and repeated description is omitted. Herein, a corresponding position in FIG. 25 is the same as the position of the main part of the thermal print head A10 in FIG. 6.

In the thermal print head A30, the configuration of the convex portion 13 of the substrate 1 is different from the configuration of that in the thermal print head A10.

Figure 25:
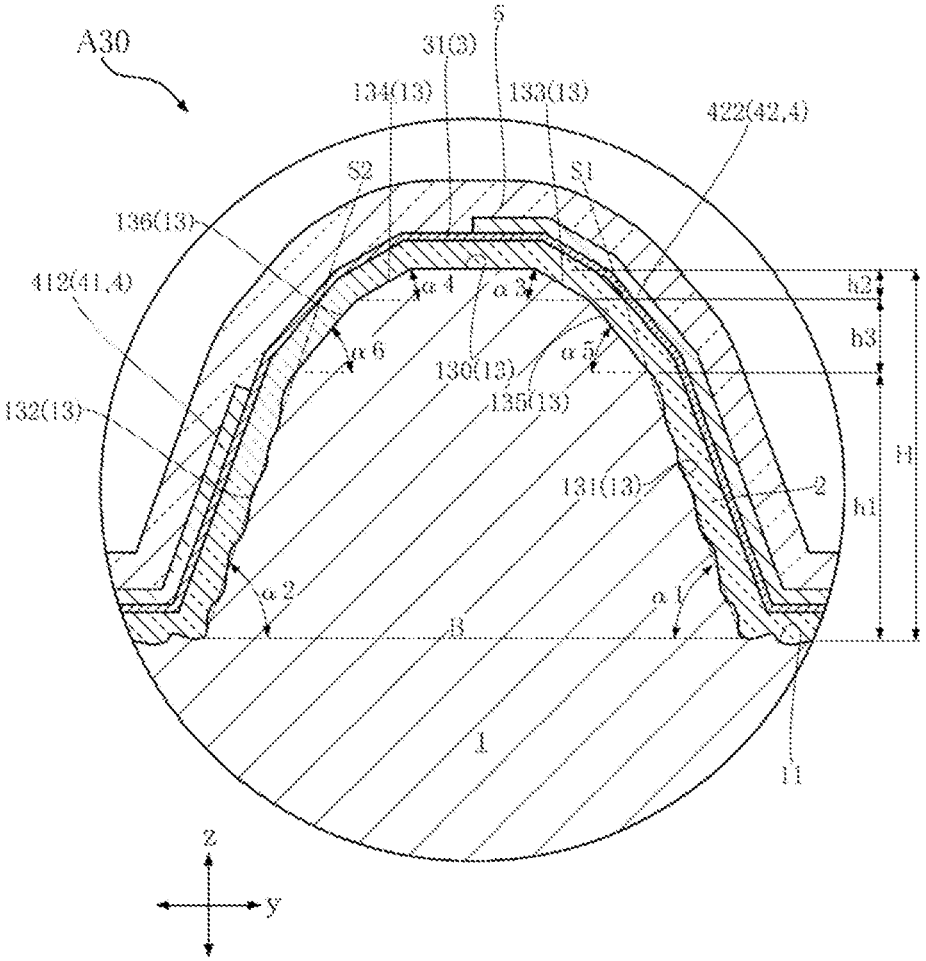
FIG. 25 is a partial enlarged cross-sectional diagram of a main part of a thermal print head according to a third embodiment of the present disclosure.

As shown in FIG. 25, the convex portion 13 has a fifth inclined surface 135. The fifth inclined surface 135 is located on the same side as the first inclined surface 131 with respect to the top surface 130 in the y direction, and is disposed between the first inclined surface 131 and the third inclined surface 133 in the z direction. The fifth inclined surface 135 is tilted with respect to the main surface 11. A fifth tilted angle α5 of the fifth inclined surface 135 with respect to the main surface 11 is greater than the third tilted angle α3 and less than the first tilted angle α1. The fifth tilted angle α5 is an acute angle formed by an intersecting angle of the imaginary reference plane B and the fifth inclined surface 135.

As shown in FIG. 25, the convex portion 13 has a sixth inclined surface 136. The sixth inclined surface 136 is located on one side opposite to the fifth inclined surface 135 with the top surface 130 in between in the y direction, and is disposed between the second inclined surface 132 and the fourth inclined surface 134 in the z direction. The sixth inclined surface 136 is tilted with respect to the main surface 11. The fifth inclined surface 135 and the sixth inclined surface 136 become closer to each other from the first inclined surface 131 and the second inclined surface 132 toward the third inclined surface 133 and the fourth inclined surface 134. A sixth tilted angle α6 of the sixth inclined surface 136 with respect to the main surface 11 is greater than the fourth tilted angle α4 and less than the second tilted angle α2. The sixth tilted angle α6 is an acute angle formed by an intersecting angle of the imaginary reference plane B and the sixth inclined surface 136.

As shown in FIG. 25, a surface roughness of the fifth inclined surface 135 is less than the surface roughness of the first inclined surface 131. A surface roughness of the sixth inclined surface 136 is less than the surface roughness of the second inclined surface 132. The dimension h1 of the first inclined surface 131 in the z direction is more than the dimension h2 of the third inclined surface 133 in the z direction and a dimension h3 of the fifth inclined surface 135 in the z direction.

Next, effects of the thermal print head A30 are given below.

The thermal print head A30 includes the substrate 1, which has the main surface 11 and the convex portion 13 and is made of a semiconductor material. The convex portion 13 has the top surface 130, the first inclined surface 131 and the second inclined surface 132. The first inclined surface 131 and the second inclined surface 132 are disposed between the main surface 11 and the top surface 130, and are tilted with respect to the main surface 11. The first tilted angle α1 of the first inclined surface 131 with respect to the main surface 11 and the second tilted angle α2 of the second inclined surface 132 with respect to the main surface 11 are greater than 55°. Thus, the thermal print head A30 is also capable of achieving enhanced printing quality and preventing interference from the platen roller 79. Therefore, the thermal print head A30 functions to provide the same effects and results equivalent to the thermal print head A10 with the common configuration as the thermal print head A10.

The thermal print head A30 has the fifth inclined surface 135 and the sixth inclined surface 136. The fifth inclined surface 135 and the sixth inclined surface 136 are disposed between the first inclined surface 131 and the second inclined surface 132, and the third inclined surface 133 and the fourth inclined surface 134, and are tilted with respect to the main surface 11. The fifth tilted angle α5 of the fifth inclined surface 135 with respect to the main surface 11 is greater than the third tilted angle α3 of the third inclined surface 133 and less than the first tilted angle α1 of the first inclined surface 131. The sixth tilted angle α6 of the sixth inclined surface 136 with respect to the main surface 11 is greater than the fourth tilted angle α4 of the fourth inclined surface 134 and less than the second tilted angle α2 of the second inclined surface 132. With the configuration above, compared to the thermal print head A20, the shape of a part of the wiring layer 4 formed along the convex portion 13 becomes smoother. Thus, in the wiring layer 4 formed along the convex portion 13, occurrences of damage and breaking of wiring patterns can be more effectively inhibited.

The present disclosure is not limited to the embodiments described above. Various design modifications may be made as desired to the specific configurations of the components of the present disclosure.

Notes regarding the thermal print head and the manufacturing method thereof provided by the present disclosure are given below.

[Note 1]

A thermal print head, including:

a substrate, having a main surface that faces a thickness direction and a convex portion that protrudes from the main surface and extends along a main scanning direction, wherein the substrate includes a semiconductor material;

a resistor layer, including a plurality of heat generating portions arranged in the main scanning direction and located on the convex portion; and a wiring layer, conducted to the plurality of heat generating portions and formed to contact the resistor layer, wherein the convex portion has a top surface, a first inclined surface and a second inclined surface, the top surface faces the thickness direction and is located away from the main surface, the first inclined surface and the second inclined surface are disposed between the main surface and the top surface, separated from each other in a sub-scanning direction, and tilted with respect to the main surface, the first inclined surface and the second inclined surface become closer to each other from the main surface toward the top surface, and a first tilted angle of the first inclined surface with respect to the main surface and a second tilted angle of the second inclined surface with respect to the main surface are greater than 55 degrees.

[Note 2]

The thermal print head of note 1, wherein the first tilted angle and the second tilted angle are less than 80 degrees.

[Note 3]

The thermal print head of note 1 or 2, wherein the convex portion has a third inclined surface, which is located on the same side as the first inclined surface with respect to the top surface in the sub-scanning direction, disposed between the first inclined surface and the top surface, and tilted with respect to the main surface, and wherein a third tilted angle of the third inclined surface with respect to the main surface is less than the first tilted angle.

[Note 4]

The thermal print head of note 3, wherein a surface roughness of the first inclined surface is greater than a surface roughness of the third inclined surface.

[Note 5]

The thermal print head of note 4, wherein a dimension of the first inclined surface in the thickness direction is greater than a dimension of the third inclined surface in the thickness direction.

[Note 6]

The thermal print head of note 4 or 5, wherein the convex portion has a fourth inclined surface, which is located on one side opposite to the third inclined surface with the top surface in between in the sub-scanning direction, disposed between the second inclined surface and the top surface, and tilted with respect to the main surface, and wherein a fourth tilted angle of the fourth inclined surface with respect to the main surface is less than the second tilted angle.

[Note 7]

The thermal print head of note 6, wherein a surface roughness of the second inclined surface is greater than a surface roughness of the fourth inclined surface.

[Note 8]

The thermal print head of note 6 or 7, wherein the convex portion has a fifth inclined surface, which is located on the same side as the first inclined surface with respect to the top surface in the sub-scanning direction, disposed between the first inclined surface and the third inclined surface, and tilted with respect to the main surface, and wherein a fifth tilted angle of the fifth inclined surface with respect to the main surface is greater than the third tilted angle and less than the first tilted angle.

[Note 9]

The thermal print head of any one of notes 1 to 8, wherein a surface roughness of each of the first inclined surface and the second inclined surface is greater than a surface roughness of the top surface.

[Note 10]

The thermal print head of note 9, wherein a surface roughness of the main surface is greater than the surface roughness of the top surface.

[Note 11]

The thermal print head of any one of notes 1 to 10, further including an insulating layer covering the main surface and the convex portion, wherein the insulating layer is interposed between the substrate and the resistor layer.

[Note 12]

The thermal print head of any one of notes 1 to 11, wherein the wiring layer includes a common wire and a plurality of individual wires, the common wire is conducted to the plurality of heat generating portions, and the plurality of individual wires are individually conducted to the plurality of heat generating portions.

[Note 13]

The thermal print head of any one of notes 1 to 12, further including a protective layer covering the plurality of heat generating portions and the wiring layer.

[Note 14]

The thermal print head of any one of notes 1 to 13, further including a heat dissipation member, wherein the substrate has a back surface facing away from the main surface in the thickness direction, and the back surface is joined to the heat dissipation member.

[Note 15]

A method for manufacturing a thermal print head, including:

forming a main surface and a convex portion on a base material that includes a semiconductor material and has a first surface and a second surface facing opposite to each other in a thickness direction, wherein the main surface faces a same side as the first surface in the thickness direction and is located between the first surface and the second surface, and the convex portion protrudes from the main surface and extends in a main scanning direction;

forming a resistor layer on the convex portion, the resistor layer including a plurality of heat generating portions arranged in the main scanning direction; and forming a wiring layer in contact with the resistor layer and conducting the plurality of heat generating portions, wherein the forming of the main surface and the convex portion includes recessing the first surface of the base material to form a plurality of grooves extending in the main scanning direction and arranged along a sub-scanning direction, the plurality of grooves have a pair of first inclined surfaces interposed between the main surface and the first surface and separated from each other in the sub-scanning direction, the pair of first inclined surfaces are tilted with respect to the main surface in a direction away from each other from the main surface toward the first surface, and a portion of the base material is removed by a blade in the forming of the plurality of grooves.

[Note 16]

The method of note 15, wherein the blade includes:

an end face, facing a radial direction of the blade; and a pair of tapered surfaces, connected to the end face and are separated from each other in a direction of a rotational axis of the blade, wherein the pair of tapered surfaces are inclined with respect to the end face to be separated from each other from the end face toward the rotational axis of the blade, and an inclination angle of each of the pair of tapered surfaces with respect to the end face is greater than 55 degrees and less than 80 degrees.

[Note 17]

The method of note 16, wherein after the plurality of grooves are formed, the forming of the main surface and the convex portion includes forming a pair of second inclined surfaces in two adjacent grooves among the plurality of grooves, wherein the pair of second inclined surfaces are interposed between the pair of first inclined surfaces and the first surface and tilted with respect to the main surface, and wherein the pair of second inclined surfaces are formed by wet etching.

[Note 18]

The method of note 17, wherein before the plurality of grooves are formed, the forming of the main surface and the convex portion includes forming a plurality of mask layers extending in the main scanning direction, arranged along the sub-scanning direction and covering the first surface, and wherein in the forming of the plurality of grooves, one of the plurality of grooves is formed between two adjacent mask layers among the plurality of mask layers.

The invention claimed is:

1. A thermal print head, comprising:

a substrate, having a main surface that faces a thickness direction and a convex portion that protrudes from the main surface and extends along a main scanning direction, wherein the substrate includes a semiconductor material;

a resistor layer, including a plurality of heat generating portions arranged in the main scanning direction and located on the convex portion; and a wiring layer, conducted to the plurality of heat generating portions and formed to contact the resistor layer, wherein the convex portion has a top surface, a first inclined surface and a second inclined surface, the top surface faces the thickness direction and is located away from the main surface, the first inclined surface and the second inclined surface are disposed between the main surface and the top surface, separated from each other in a sub-scanning direction, and tilted with respect to the main surface, the first inclined surface and the second inclined surface become closer to each other from the main surface toward the top surface, a first tilted angle of the first inclined surface with respect to the main surface and a second tilted angle of the second inclined surface with respect to the main surface are greater than 55 degrees (55°), and a surface roughness of each of the first inclined surface and the second inclined surface is greater than a surface roughness of the top surface.

2. The thermal print head of claim 1, wherein the first tilted angle and the second tilted angle are less than 80 degrees (80°).

3. The thermal print head of claim 1, wherein the convex portion has a third inclined surface, which is:

located on the same side as the first inclined surface with respect to the top surface in the sub-scanning direction, disposed between the first inclined surface and the top surface, and tilted with respect to the main surface, and wherein a third tilted angle of the third inclined surface with respect to the main surface is less than the first tilted angle.

4. The thermal print head of claim 2, wherein the convex portion has a third inclined surface, which is:

located on the same side as the first inclined surface with respect to the top surface in the sub-scanning direction, disposed between the first inclined surface and the top surface, and tilted with respect to the main surface, and wherein a third tilted angle of the third inclined surface with respect to the main surface is less than the first tilted angle.

5. The thermal print head of claim 3, wherein the surface roughness of the first inclined surface is greater than a surface roughness of the third inclined surface.

6. The thermal print head of claim 5, wherein a dimension of the first inclined surface in the thickness direction is greater than a dimension of the third inclined surface in the thickness direction.

7. The thermal print head of claim 5, wherein the convex portion has a fourth inclined surface, which is:

located on one side opposite to the third inclined surface with the top surface in between in the sub-scanning direction, disposed between the second inclined surface and the top surface, and tilted with respect to the main surface, and wherein a fourth tilted angle of the fourth inclined surface with respect to the main surface is less than the second tilted angle.

8. The thermal print head of claim 6, wherein the convex portion has a fourth inclined surface, which is:

located on one side opposite to the third inclined surface with the top surface in between in the sub-scanning direction, disposed between the second inclined surface and the top surface, and tilted with respect to the main surface, and wherein a fourth tilted angle of the fourth inclined surface with respect to the main surface is less than the second tilted angle.

9. The thermal print head of claim 7, wherein the surface roughness of the second inclined surface is greater than a surface roughness of the fourth inclined surface.

10. The thermal print head of claim 7, wherein the convex portion has a fifth inclined surface, which is:

located on same side as the first inclined surface with respect to the top surface in the sub-scanning direction, disposed between the first inclined surface and the third inclined surface, and tilted with respect to the main surface, and wherein a fifth tilted angle of the fifth inclined surface with respect to the main surface is greater than the third tilted angle and less than the first tilted angle.

11. The thermal print head of claim 1, wherein a surface roughness of the main surface is greater than the surface roughness of the top surface.

12. The thermal print head of claim 1, further comprising an insulating layer covering the main surface and the convex portion, wherein the insulating layer is interposed between the substrate and the resistor layer.

13. The thermal print head of claim 1, wherein the wiring layer includes a common wire and a plurality of individual wires, the common wire is conducted to the plurality of heat generating portions, and the plurality of individual wires are individually conducted to the plurality of heat generating portions.

14. The thermal print head of claim 1, further comprising a protective layer covering the plurality of heat generating portions and the wiring layer.

15. The thermal print head of claim 1, further comprising a heat dissipation member, wherein the substrate has a back surface facing away from the main surface in the thickness direction, and the back surface is joined to the heat dissipation member.

16. A method for manufacturing a thermal print head, comprising:

forming a main surface and a convex portion on a base material that includes a semiconductor material and has a first surface and a second surface facing opposite to each other in a thickness direction, wherein the main surface faces same side as the first surface in the thickness direction and is located between the first surface and the second surface, the convex portion protrudes from the main surface and extends in a main scanning direction;

forming a resistor layer on the convex portion, the resistor layer including a plurality of heat generating portions arranged in the main scanning direction; and forming a wiring layer in contact with the resistor layer and conducting the plurality of heat generating portions, wherein the forming of the main surface and the convex portion includes recessing the first surface of the base material to form a plurality of grooves extending in the main scanning direction and arranged along the sub-scanning direction, the plurality of grooves have a pair of first inclined surfaces interposed between the main surface and the first surface, separated from each other in the sub-scanning direction, the pair of first inclined surfaces are tilted with respect to the main surface in a direction away from each other from the main surface toward the first surface, and a portion of the base material is removed by a blade in the forming of the plurality of grooves, wherein the blade includes:

an end face, facing a radial direction of the blade; and a pair of tapered surfaces, connected to the end face and are separated from each other in a direction of a rotational axis of the blade, wherein the pair of tapered surfaces are inclined with respect to the end face to be separated from each other from the end face toward the rotational axis of the blade, and an inclination angle of each of the pair of tapered surfaces with respect to the end face is greater than 55° and less than 80°.

17. The method of claim 16, wherein after the plurality of grooves are formed, the forming of the main surface and the convex portion includes forming a pair of second inclined surfaces in two adjacent grooves among the plurality of grooves, wherein the pair of second inclined surfaces are interposed between the pair of first inclined surfaces and the first surface and tilted with respect to the main surface, and wherein the pair of second inclined surfaces are formed by wet etching.

18. The method of claim 17, wherein before the plurality of grooves are formed, the forming of the main surface and the convex portion includes forming a plurality of mask layers extending in the main scanning direction, arranged along the sub-scanning direction and covering the first surface, and wherein in the forming of the plurality of grooves, one of the plurality of grooves is formed between two adjacent mask layers among the plurality of mask layers.

* * * * *